US010919608B1

(12) United States Patent
Kunanec et al.

(10) Patent No.: US 10,919,608 B1
(45) Date of Patent: Feb. 16, 2021

(54) JET PROPULSION SYSTEM FOR A WATERCRAFT

(71) Applicant: BOMBARDIER RECREATIONAL PRODUCTS INC., Valcourt (CA)

(72) Inventors: Robert Kunanec, Bromont (CA); Frederick Lasnier, Sainte-Cecile-de-Milton (CA)

(73) Assignee: BOMBARDIER RECREATIONAL PRODUCTS INC., Valcourt (CA)

( * ) Notice: Subject to any disclaimer, the term of this patent is extended or adjusted under 35 U.S.C. 154(b) by 0 days.

(21) Appl. No.: 16/457,204

(22) Filed: Jun. 28, 2019

Related U.S. Application Data

(60) Provisional application No. 62/692,491, filed on Jun. 29, 2018.

(51) Int. Cl.
*B63H 11/08* (2006.01)
*B63H 11/01* (2006.01)
*B63B 34/10* (2020.01)

(52) U.S. Cl.
CPC ..... *B63H 11/08* (2013.01); *B63B 34/10* (2020.02); *B63H 11/01* (2013.01)

(58) Field of Classification Search
CPC ..... B63H 11/08; B63H 11/01; B63B 34/10
See application file for complete search history.

(56) References Cited

U.S. PATENT DOCUMENTS 3,338,169 A * 8/1967 Kinney ..... B63H 20/32 415/61
4,027,617 A 6/1977 Ikeda et al.
4,373,919 A 2/1983 Stangeland
5,123,867 A 6/1992 Broinowski
5,151,057 A 9/1992 Kobayashi et al.
5,176,547 A 1/1993 Kobayashi et al.
5,176,548 A 1/1993 Morgan
5,184,966 A 2/1993 Kobayashi et al.
5,224,887 A 7/1993 Futaki
5,254,023 A 10/1993 Kobayashi
5,254,024 A 10/1993 Kobayashi et al.
5,468,165 A 11/1995 Weber et al.
5,490,504 A 2/1996 Vrona et al.
5,509,832 A 4/1996 Roos
5,522,742 A 6/1996 Futaki et al.
5,577,941 A 11/1996 Chartier
5,598,804 A 2/1997 Vostitsanos
5,690,520 A 11/1997 Rheault
(Continued)

*Primary Examiner* — Stephen P Avila
(74) *Attorney, Agent, or Firm* — BCF LLP

(57) ABSTRACT

A jet propulsion system for a watercraft includes a duct defining an inlet, a venturi unit, an impeller housing disposed between the inlet and the venturi unit, and an impeller disposed within the impeller housing. The impeller is rotatable in a forward direction and a reverse direction. The venturi unit includes a venturi conduit and at least one door connected thereto. The venturi conduit has a peripheral wall defining at least one aperture. The at least one door is movable between a closed position when the impeller rotates in the forward direction, and an open position when the impeller rotates in the reverse direction. In the closed position, the at least one door closes the at least one aperture. In the open position, the at least one door opens the at least one aperture such that water flows into the venturi conduit via the at least one aperture.

16 Claims, 16 Drawing Sheets

(56) References Cited

U.S. PATENT DOCUMENTS

| | | | | |
|---|---|---|---|---|
| 5,779,508 | A | 7/1998 | Pettesch et al. | |
| 5,846,105 | A | 12/1998 | Baker et al. | |
| 5,863,229 | A | 1/1999 | Matte | |
| 5,876,258 | A | 3/1999 | Gray | |
| 5,934,953 | A | 8/1999 | Kobayashi | |
| 5,951,130 | A | 9/1999 | Braunschweig et al. | |
| 5,989,083 | A | 11/1999 | Ishigaki et al. | |
| 6,033,272 | A | 3/2000 | Whiteside | |
| 6,083,063 | A | 7/2000 | Neisen | |
| 6,183,319 | B1 | 2/2001 | Ishigaki | |
| 6,267,632 | B1 | 7/2001 | Blanchard | |
| 6,283,805 | B1 | 9/2001 | Ishigaki | |
| 6,293,836 | B1 | 9/2001 | Blanchard | |
| 6,482,055 | B1 | 11/2002 | Freitag | |
| 6,645,018 | B2 | 11/2003 | Ishigaki | |
| 6,821,167 | B2 | 11/2004 | Ishigaki et al. | |
| 6,857,920 | B2 | 2/2005 | Marathe et al. | |
| 6,899,575 | B1 | 5/2005 | Rothe et al. | |
| 7,377,826 | B1 | 5/2008 | Wengren, Jr. | |
| 7,950,974 | B2 | 5/2011 | Rui | |
| 8,007,329 | B2 | 8/2011 | Wengren, Jr. | |
| 9,346,522 | B2 | 5/2016 | Ruosteinen et al. | |
| 2012/0011828 | A1* | 1/2012 | Nicholson ..... | B63H 11/08 60/229 |
| 2012/0178318 | A1 | 7/2012 | Rasidescu et al. | |

* cited by examiner

JET PROPULSION SYSTEM FOR A WATERCRAFT

CROSS-REFERENCE

The present application claims priority to U.S. Provisional Patent Application No. 62/692,491, filed on Jun. 29, 2018, the entirety of which is incorporated herein by reference.

FIELD OF THE TECHNOLOGY

The present technology relates to a jet propulsion system for a watercraft.

BACKGROUND

Water jet propelled watercraft offer high performance, good acceleration and handling, and allow for shallow-water operation. Accordingly, personal watercrafts (PWCs), which typically employ water jet propulsion systems, have become popular, especially in resort areas.

A common problem with jet propulsion systems is that foreign objects such as vegetation (e.g. weeds), rocks, rope and other debris can get drawn into the jet propulsion system and remain lodged therein. For example, foreign objects can get caught on an intake grate, a driveshaft or an impeller of the jet propulsion system. Clogs caused by these foreign objects can in turn adversely affect performance of the system, notably by reducing a thrust generated by the jet propulsion system. In turn, the reduced thrust in combination with high speed rotation of the impeller can form low pressure areas around the blades of the impeller and thus cause cavitation thereof. In addition, the clogs can in some cases block cooling water flow and thus lead to overheating. While the jet propulsion system can be unclogged manually by accessing a bottom of the watercraft's hull, this can be a difficult and time-consuming task for the operator.

To address this issue, it has been proposed to operate a jet propulsion system in reverse such as to propel water towards an inlet thereof (as opposed to a rearward outlet at a steering nozzle of the jet propulsion system) and use the generated thrust to clear clogs in the jet propulsion system. However, when the jet propulsion system is operated in reverse, water flows in reverse through a venturi unit thereof which reduces the speed of the water flow as water enters through the smaller outlet and exits through the bigger inlet of the venturi unit. This makes dislodging foreign bodies in the jet propulsion difficult since thrust is reduced. Moreover, merely increasing the rotational speed of the impeller is not a practicable solution to compensate for the reduced thrust since this would generate a greater pressure differential from the smaller outlet of the venturi unit to the impeller which can cause cavitation of the impeller.

In view of the foregoing, there is a need for a watercraft with a jet propulsion system that can be more easily unclogged.

SUMMARY

It is an object of the present technology to ameliorate at least some of the inconveniences present in the prior art.

According to one aspect of the present technology, there is provided a jet propulsion system for a watercraft. The jet propulsion system includes: a duct defining an inlet; a venturi unit defining part of the duct and defining a venturi outlet; an impeller housing defining part of the duct and disposed between the inlet and the venturi unit; and an impeller disposed within the impeller housing. The impeller is rotatable about an impeller rotation axis in (i) a forward direction whereby the impeller propels water out of the venturi outlet, and (ii) a reverse direction whereby the impeller propels water out of the inlet. The venturi unit includes a venturi conduit having a peripheral wall defining at least one aperture. The venturi conduit defines a venturi inlet and the venturi outlet. The venturi inlet has a greater cross-sectional area than the venturi outlet. When the impeller rotates in the forward direction, water flows from the venturi inlet to the venturi outlet. When the impeller rotates in the reverse direction, water flows from the venturi outlet to the venturi inlet. The venturi unit also includes at least one door connected to the venturi conduit. The at least one door is movable between a closed position when the impeller rotates in the forward direction, and an open position when the impeller rotates in the reverse direction. In the closed position, the at least one door closes the at least one aperture. In the open position, the at least one door opens the at least one aperture such that water flows into the venturi conduit via the at least one aperture.

In some embodiments of the present technology, in the open position, the at least one door opens the at least one aperture such that water flows into the venturi conduit via the at least one aperture and the venturi outlet.

In some embodiments of the present technology, the at least one door includes a plurality of doors.

In some embodiments of the present technology, each of the at least one door includes a door seat and a door member pivotably connected to the door seat. In the closed position of the at least one door, the door member is shut against the door seat. In the open position of the at least one door, the door member is pivoted inwardly such that at least part of the door member is pivoted into the venturi conduit.

In some embodiments of the present technology, the plurality of doors includes no more than four doors.

In some embodiments of the present technology, the doors of the plurality of doors are distributed along a bottom half of the venturi conduit.

In some embodiments of the present technology, the venturi conduit includes a plurality of vanes extending longitudinally along an inner side of the peripheral wall. The vanes are circumferentially spaced from one another. Each of the doors of the plurality of doors is positioned between two of the vanes.

In some embodiments of the present technology, the at least one door is generally triangular.

In some embodiments of the present technology, the at least one door is passively actuated between the closed and open positions such that: when a pressure inside the venturi conduit is less than a pressure outside the venturi conduit, the at least one door assumes the open position; and when the pressure inside the venturi conduit is greater than the pressure outside the venturi conduit, the at least one door assumes the closed position.

In some embodiments of the present technology, the jet propulsion system also includes a reverse stator disposed between the impeller and the inlet of the duct. The reverse stator is generally annular and includes a plurality of vanes extending radially within the duct.

In some embodiments of the present technology, the jet propulsion system also includes an intake ramp defining part of the duct and extending from the inlet of the duct to the impeller housing.

In some embodiments of the present technology, the jet propulsion system also includes a drive shaft operatively connected to the impeller to cause rotation of the impeller about the impeller rotation axis. The driveshaft is adapted for connection to a gearbox.

In some embodiments of the present technology, the jet propulsion system also includes a forward stator disposed between the impeller and the venturi unit. The forward stator includes a plurality of vanes extending radially within the duct.

In some embodiments of the present technology, the jet propulsion system also includes a nose cone mounted to the forward stator and extending into the venturi unit. The at least one door abuts the nose cone in the open position.

In some embodiments of the present technology, the jet propulsion system also includes a grate adjacent to or in the inlet of the duct.

According to another aspect of the present technology, there is provided a watercraft. The watercraft includes: a hull having a bow and a stern opposite the bow; a motor supported by the hull; and a jet propulsion system. The jet propulsion system includes: a duct defining an inlet in a bottom of the hull; a venturi unit defining part of the duct and defining a venturi outlet; an impeller housing defining part of the duct and disposed between the inlet and the venturi unit; and an impeller disposed within the impeller housing. The impeller is operatively connected to the motor. The impeller is rotatable about an impeller rotation axis in (i) a forward direction whereby the impeller propels water rearwardly, and (ii) a reverse direction whereby the impeller propels water forwardly. The venturi unit includes a venturi conduit having a peripheral wall defining at least one aperture. The venturi conduit defines a venturi inlet and the venturi outlet. The venturi inlet has a greater cross-sectional area than the venturi outlet. When the impeller rotates in the forward direction, water flows from the venturi inlet to the venturi outlet. When the impeller rotates in the reverse direction, water flows from the venturi outlet to the venturi inlet. The venturi unit also includes at least one door connected to the venturi conduit. The at least one door is movable between a closed position when the impeller rotates in the forward direction, and an open position when the impeller rotates in the reverse direction. In the closed position, the at least one door closes the at least one aperture, and in the open position, the at least one door opens the at least one aperture such that water flows into the venturi conduit via the at least one aperture.

According to another aspect of the present technology, there is provided a venturi conduit for a jet propulsion system. The venturi unit includes a venturi conduit having a peripheral wall defining at least one aperture. The venturi conduit defines a venturi inlet and a venturi outlet. The venturi inlet has a greater cross-sectional area than the venturi outlet. The venturi unit also includes at least one door connected to the venturi conduit. The at least one door is movable between a closed position and an open position. In the closed position, the at least one door closes the at least one aperture. In the open position, the at least one door opens the at least one aperture.

According to another aspect of the present technology, there is provided a kit for cleaning an inlet grate of a jet propulsion system. The kit includes a venturi unit including a venturi conduit having a peripheral wall defining at least one aperture. The venturi conduit defines a venturi inlet and a venturi outlet. The venturi inlet has a greater cross-sectional area than the venturi outlet. The venturi unit also includes at least one door connected to the venturi conduit. The at least one door is movable between a closed position and an open position. In the closed position, the at least one door closes the at least one aperture. In the open position, the at least one door opens the at least one aperture. The kit also includes a gearbox adapted for changing a direction of rotation of an impeller of the jet propulsion system for changing a direction of a flow of water through the venturi conduit.

In some embodiments of the present technology, the kit also includes a driveshaft adapter for connecting the gearbox to the impeller of the jet propulsion system.

For purposes of this application, the terms related to spatial orientation such as forwardly, rearward, left and right, are as they would normally be understood by a driver of a vehicle sitting thereon in a normal driving position.

Embodiments of the present technology each have at least one of the above-mentioned objects and/or aspects, but do not necessarily have all of them. It should be understood that some aspects of the present technology that have resulted from attempting to attain the above-mentioned objects may not satisfy these objects and/or may satisfy other objects not specifically recited herein.

Additional and/or alternative features, aspects, and advantages of embodiments of the present technology will become apparent from the following description, the accompanying drawings, and the appended claims.

BRIEF DESCRIPTION OF THE DRAWINGS

For a better understanding of the present technology, as well as other aspects and further features thereof, reference is made to the following description which is to be used in conjunction with the accompanying drawings, where.

DETAILED DESCRIPTION

Figure 1:
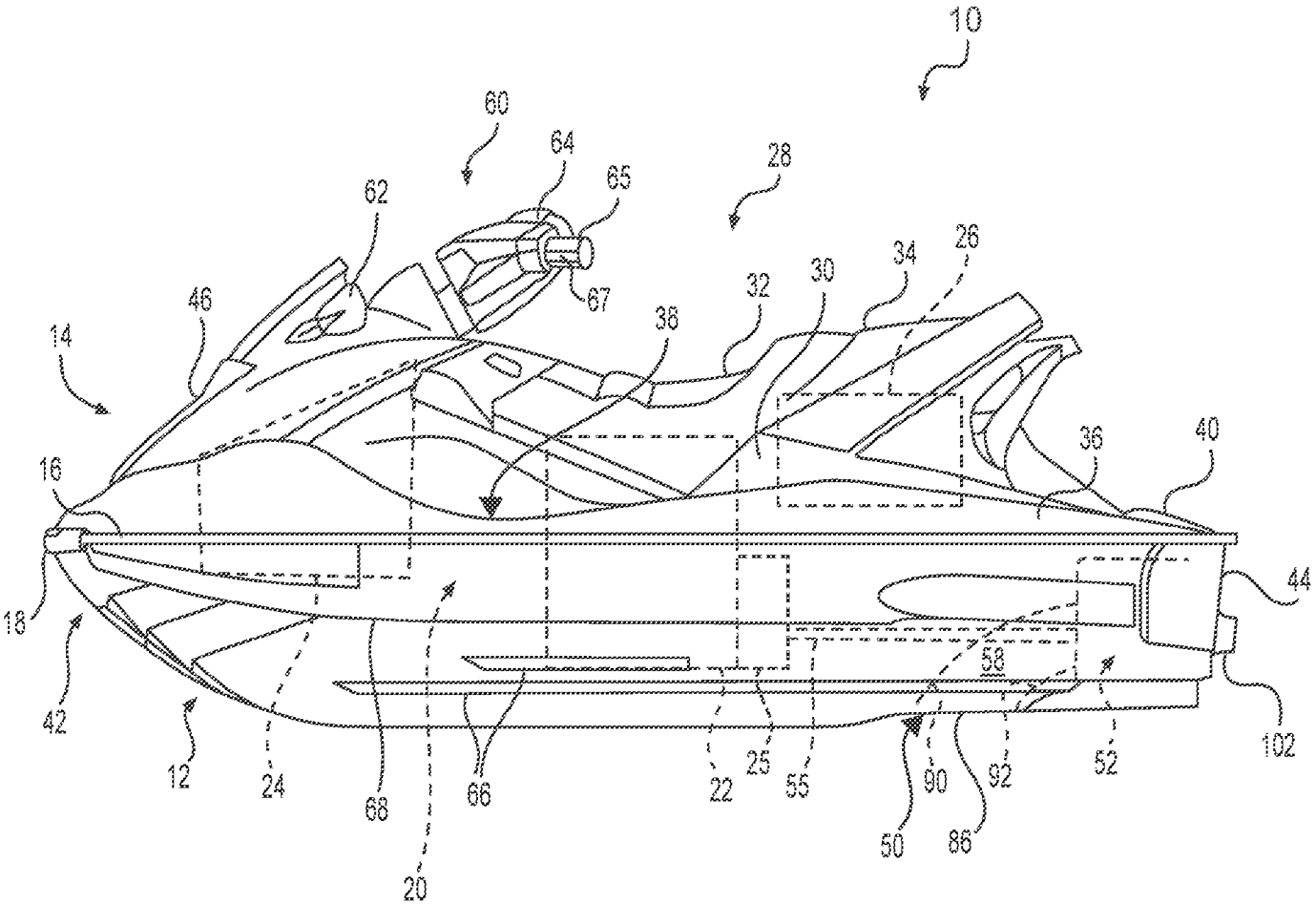
FIG. 1 is a left side elevation view of a personal watercraft in accordance with an embodiment of the present technology.

A personal watercraft 10 in accordance with one embodiment of the present technology is shown in FIGS. 1 to 5. The following description relates to one example of a personal watercraft. Those of ordinary skill in the art will recognize that there are other known types of personal watercraft incorporating different designs and that the present technology would encompass these other watercraft.

As will be discussed in greater detail below, the personal watercraft 10 has a jet propulsion system 50 for propelling the watercraft 10. In accordance with the present technology, the jet propulsion system 50, including a venturi unit 100 thereof, is configured to reverse a flow of water therein in such a manner as to clear the jet propulsion system 50 of foreign bodies. Notably, the venturi unit 100 is configured to provide additional thrust to the jet propulsion system 50 when the flow of water is reversed so as to facilitate its unclogging.

The general construction of the personal watercraft 10 will now be described with respect to FIGS. 1 to 5.

The watercraft 10 has a hull 12 and a deck 14. The hull 12 has a bow 42 and a stern 44 opposite the bow 42. The hull 12 buoyantly supports the watercraft 10 in the water. The deck 14 is designed to accommodate one or multiple riders. The hull 12 and the deck 14 are joined together at a seam 16 that joins the parts in a sealing relationship. A bumper 18 generally covers the seam 16, which helps to prevent damage to the outer surface of the watercraft 10 when the watercraft 10 is docked, for example.

As seen in FIG. 1, the deck 14 has a centrally positioned straddle-type seat 28 positioned on top of a pedestal 30 to accommodate multiple riders in a straddling position. The seat 28 includes a front seat portion 32 and a rear, raised seat portion 34. The seat 28 is preferably made as a cushioned or padded unit, or as interfitting units. The front and rear seat portions 32, 34 are removably attached to the pedestal 30. The seat portions 32, 34 can be individually tilted or removed completely. Seat portion 32 covers a motor access opening defined by a top portion of the pedestal 30 to provide access to a motor 22. Seat portion 34 covers a removable storage bin 26 (FIG. 1). A small storage box is provided in front of the seat 28.

Figure 2:
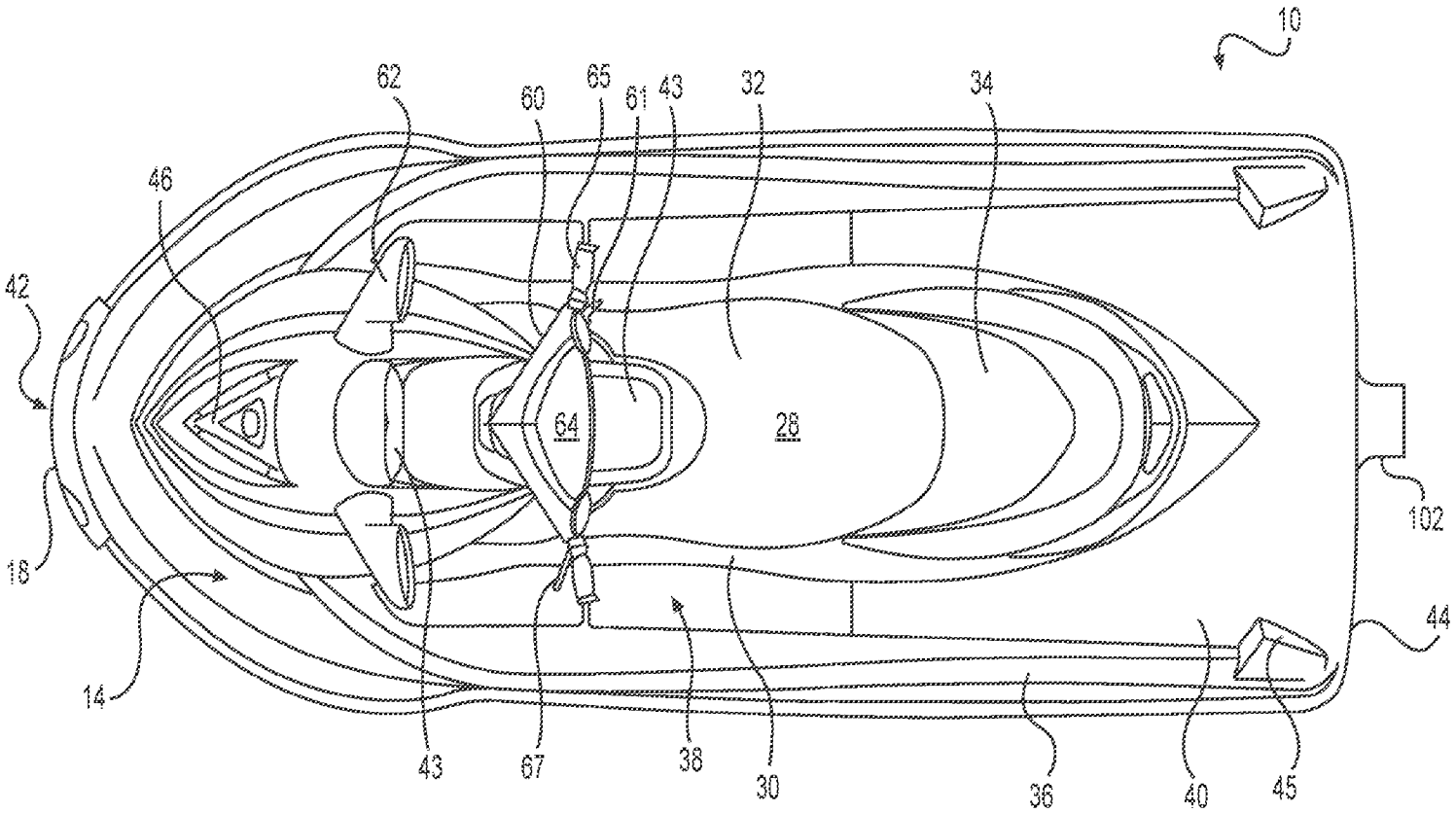
FIG. 2 is a top plan view of the watercraft of FIG. 1.

The watercraft 10 has a pair of generally upwardly extending walls located on either side of the watercraft 10 known as gunwales or gunnels 36. The gunnels 36 help to prevent the entry of water in the footrests 38 of the watercraft 10, provide lateral support for the riders' feet, and also provide buoyancy when turning the watercraft 10, since the personal watercraft 10 rolls slightly when turning. Towards the rear of the watercraft 10, the gunnels 36 extend inwardly to act as heel rests 45 (FIG. 2). A passenger riding the watercraft 10 facing towards the rear, to spot a water-skier for example, may place his or her heels on the heel rests 45, thereby providing a more stable riding position. Heel rests 45 could also be formed separately from the gunnels 36.

Located on both sides of the watercraft 10, between the pedestal 30 and the gunnels 36, are the footrests 38. The footrests 38 are designed to accommodate the riders' feet in various riding positions. The footrests 38 are covered by carpeting made of a rubber-type material, for example, to provide additional comfort and traction for the feet of the riders.

A reboarding platform 40 is provided at the rear of the watercraft 10 on the deck 14 to allow the rider or a passenger to easily reboard the watercraft 10 from the water. Carpeting or some other suitable covering may cover the reboarding platform 40. A retractable ladder (not shown) may be affixed to a transom 47 of the stern 44 to facilitate boarding the watercraft 10 from the water onto the reboarding platform 40.

Referring to the bow 42 of the watercraft 10, as seen in FIG. 1, the watercraft 10 is provided with a hood 46 located forwardly of the seat 28 and a helm assembly 60. A hinge (not shown) is attached between a forward portion of the hood 46 and the deck 14 to allow the hood 46 to move to an open position to provide access to a front storage bin 24. A latch (not shown) located at a rearward portion of the hood 46 locks the hood 46 into a closed position. When in the closed position, the hood 46 prevents water from entering the front storage bin 24. Rearview mirrors 62 are positioned on either side of the hood 46 to allow the rider to see behind the watercraft 10. A hook 63 is located at the bow 42 of the watercraft 10 (FIG. 2). The hook 63 is used to attach the watercraft 10 to a dock when the watercraft 10 is not in use or to attach to a winch when loading the watercraft 10 on a trailer, for instance.

As best seen in FIG. 2, the hull 12 is provided with a combination of strakes 66 and chines 68. A strake 66 is a protruding portion of the hull 12. A chine 68 is the vertex formed where two surfaces of the hull 12 meet. The combination of strakes 66 and chines 68 provide the watercraft 10 with its riding and handling characteristics.

Sponsons 77 are located on both sides of the hull 12 near the transom 47. The sponsons 77 have an arcuate undersurface that gives the watercraft 10 both lift while in motion and improved turning characteristics. The sponsons 77 are fixed to the surface of the hull 12 and can be attached to the hull 12 by fasteners or molded therewith. It is contemplated that the position of the sponsons 77 with respect to the hull 12 may be adjustable to change the handling characteristics of the watercraft 10 and accommodate different riding conditions.

The hull 12 has a tunnel 94 in which part of the jet propulsion system 50 is received. The tunnel 94 is defined at the front, sides and top by the hull 12 and is open at the transom 47. The bottom of the tunnel 94 is closed by a ride plate 96. The ride plate 96 creates a surface on which the watercraft 10 rides or planes at high speeds.

Figure 3:
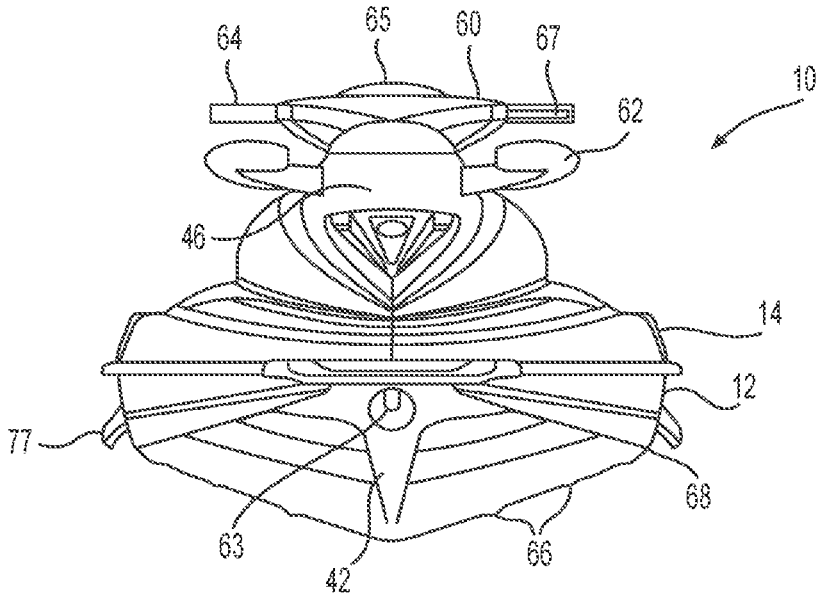
FIG. 3 is a front elevation view of the watercraft of FIG. 1.
Figure 4:
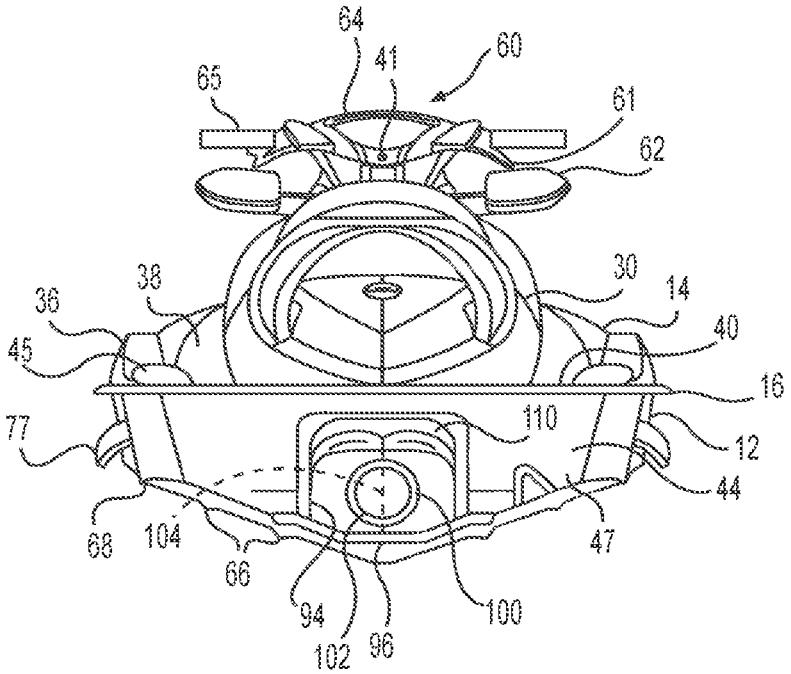
FIG. 4 is a rear elevation view of the watercraft of FIG. 1.

As best seen in FIGS. 3 and 4, the helm assembly 60 is positioned forwardly of the seat 28. The helm assembly 60 has a central helm portion 64, that is padded, and a pair of steering handles 65, also referred to as a handlebar. One of the steering handles 65 is provided with a throttle operator 61 (FIGS. 2, 4), which allows the rider to control the motor 22, and therefore the speed of the watercraft 10. The throttle operator 61 is a thumb-actuated throttle lever. However it is contemplated that the throttle operator 61 could be a finger-actuated throttle lever or a twist grip. The throttle operator 61 is movable between an idle position and multiple actuated positions. In the present embodiment, the throttle operator 61 is biased towards the idle position, such that, should the driver of the watercraft 10 let go of the throttle operator 61, it will move to the idle position. The other of the steering handles 65 is provided with a reverse gate operator 67 used by the driver to actuate a reverse gate 110 (FIG. 4) of the watercraft 10 as described in greater detail below. The reverse gate operator 67 is a finger-actuated lever. However, it is contemplated that the reverse gate operator 67 could be a thumb-actuated lever or a twist grip.

As shown in FIG. 4, the helm assembly 60 is provided with a key receiving post 41 located near a center of the central helm portion 64. The key receiving post 41 is adapted to receive a key (not shown) that starts the watercraft 10. As is known, the key is typically attached to a safety lanyard (not shown). It should be noted that the key receiving post 41 may be placed in any suitable location on the watercraft 10.

As shown in FIG. 2, a display area or cluster 43 is located forwardly of the helm assembly 60. The display cluster 43 can be of any conventional display type, including a liquid crystal display (LCD), dials or LED (light emitting diodes). The central helm portion 64 has various buttons, which could alternatively be in the form of levers or switches, that allow the driver to modify the display data or mode (speed, engine rpm, time, etc.) on the display cluster 43 or to change a condition of the watercraft 10, such as trim (the pitch of the watercraft 10).

As shown schematically in FIG. 1, the motor 22 is supported by the hull 12 and is enclosed within a motor compartment 20 defined between the hull 12 and the deck 14. The motor 22 is configured for driving the jet propulsion system 50 (also commonly referred to as a "jet pump drive") which propels the watercraft 10. The motor compartment 20 accommodates the motor 22, as well as a muffler, tuning pipe, gas tank, electrical system (battery, electronic control unit, etc.), air box, storage bins 24, 26, and other elements required or desirable in the watercraft 10. In this embodiment, the motor 22 is an internal combustion engine 22 and will thus be referred to as the engine 22. However, it is contemplated that, in alternative embodiments, the engine 22 may be any other suitable type of motor such as an electric motor. As will be understood, in such an embodiment, certain components would be added to or omitted from the watercraft 10 (e.g., no muffler and gas tank, etc.).

Figure 6:
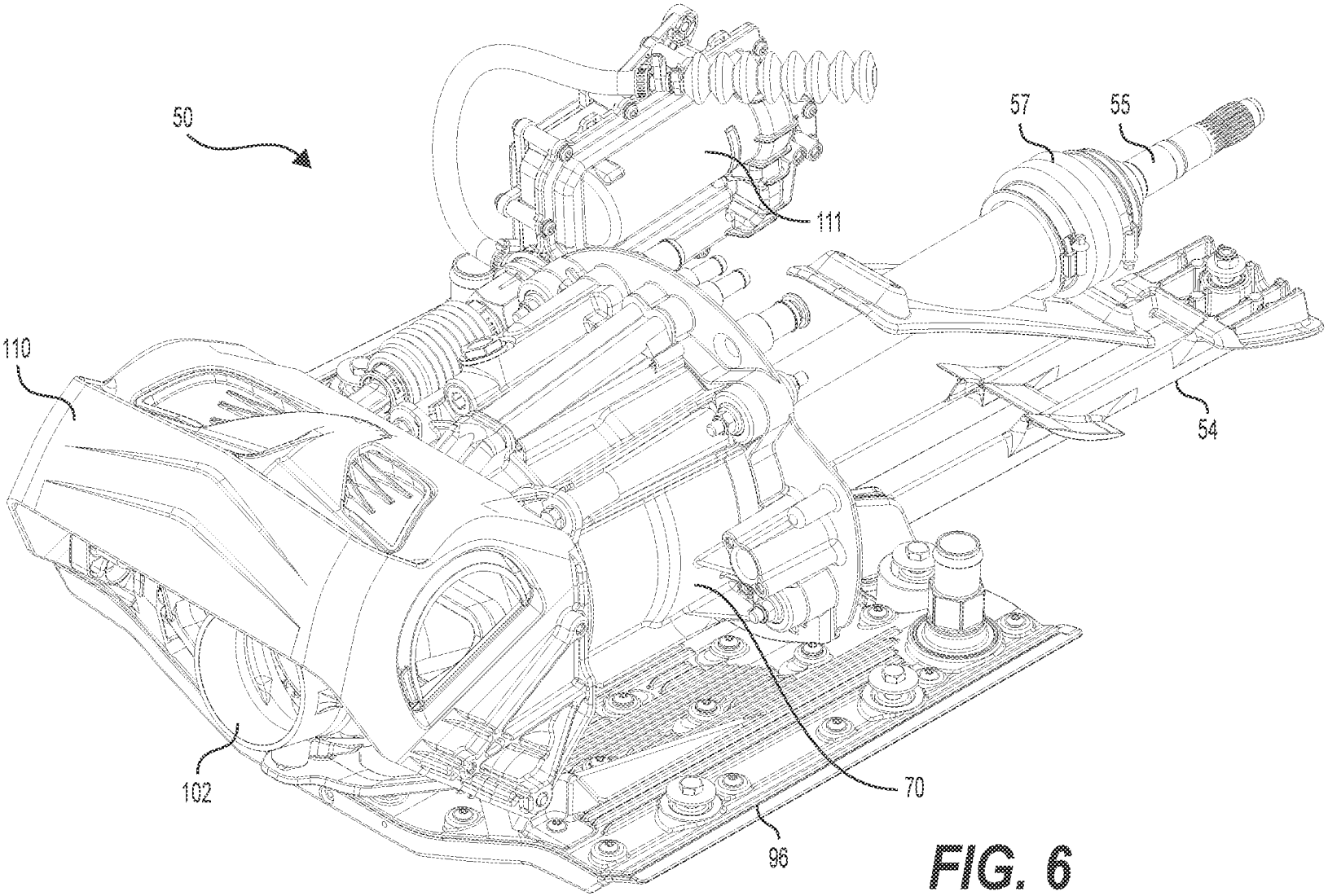
FIG. 6 is a perspective view, taken from a rear, right side, of a jet propulsion system of the watercraft of FIG. 1.
Figure 7:
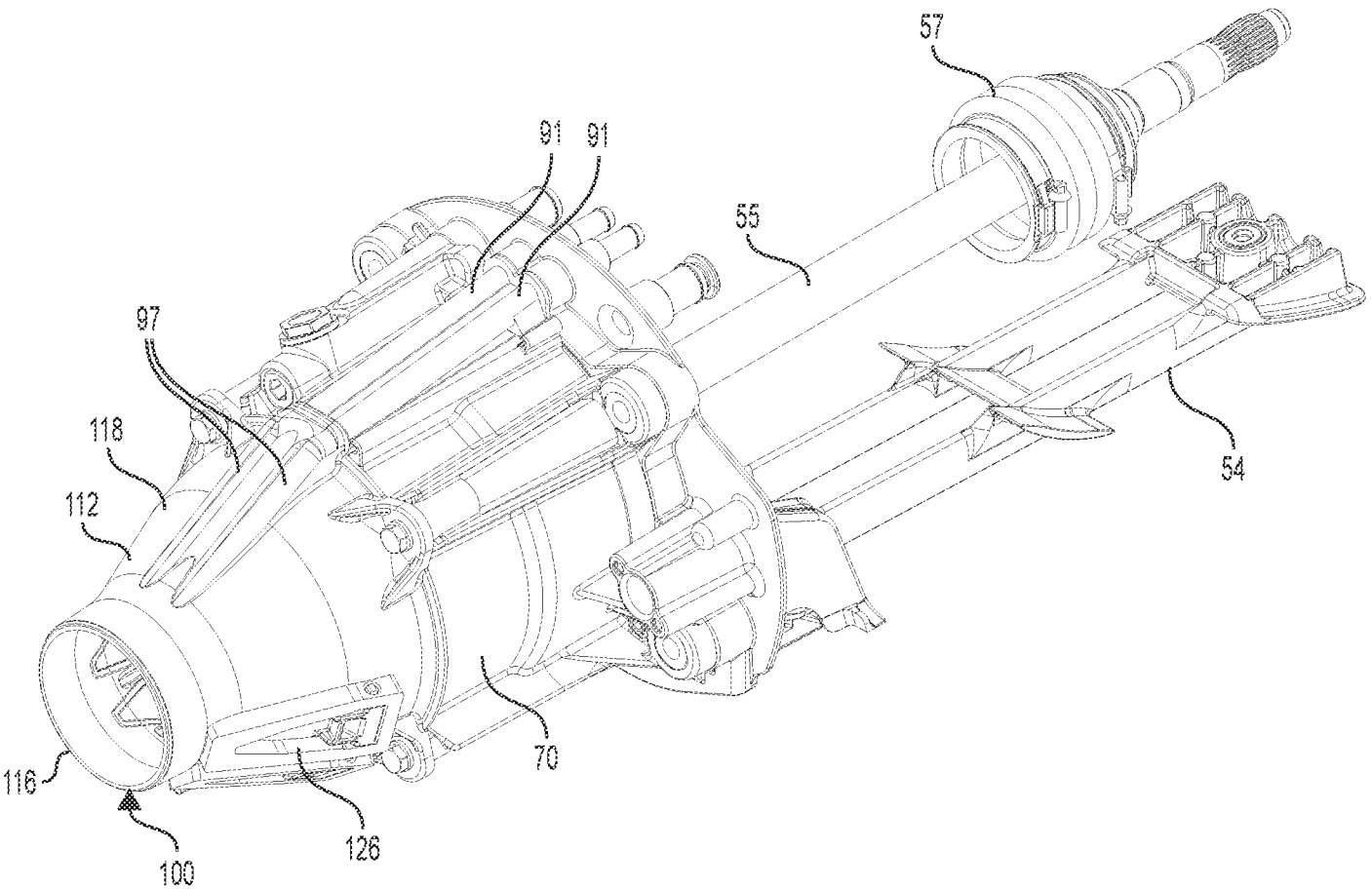
FIG. 7 is a perspective view, taken from a rear, right side, of the jet propulsion system of FIG. 6 with a steering nozzle, a reverse gate, and other components removed therefrom.

The engine 22 has a crankshaft (not shown) that extends longitudinally. A gearbox 25 is connected to the crankshaft and is disposed in the motor compartment 20 rearwardly of the engine 22. A driveshaft 55 is connected to the gearbox 25 and is connected to the jet propulsion system 50 as will be described further below. A bellow assembly 57 (FIG. 6) is mounted to the driveshaft 55 and provides a seal between the duct 52 and the hull 12 such as to prevent entry of water into the hull 12. The gearbox 25 is operable to selectively change a direction of rotation of the driveshaft 55. Notably, the gearbox 25 can selectively rotate the driveshaft 55 clockwise or counter clockwise by engaging different gearing to drive the driveshaft 55. In an alternative embodiment, the gearbox 25 is omitted and the direction of rotation of the driveshaft 55 can be changed by changing the direction of rotation of the crankshaft by using an engine control strategy such as the Rotax Electronic Reverse™ for example.

As mentioned above, the watercraft 10 is propelled by the jet propulsion system 50 which pressurizes water to create thrust. To that end, the jet propulsion system 50 has a duct 52 (FIG. 1) in which water is pressurized and which is defined by various components of the jet propulsion system 50. Notably, the duct 52 is defined in part by an intake ramp 58, an impeller housing 70, a venturi unit 100 and a steering nozzle 102 of the jet propulsion system 50. These components will be described in greater detail below.

The jet propulsion system 50 can be operated to propel water forwardly or rearwardly along the duct 52. Notably, when motion of the watercraft 10 is desired, the jet propulsion system 50 is selectively made to propel water rearwardly along the duct 52. However, as will be explained further below, the jet propulsion system 50 can also be selectively made to propel water forwardly along the duct 52 in order to clear foreign bodies clogging the duct 52.

Figure 5:
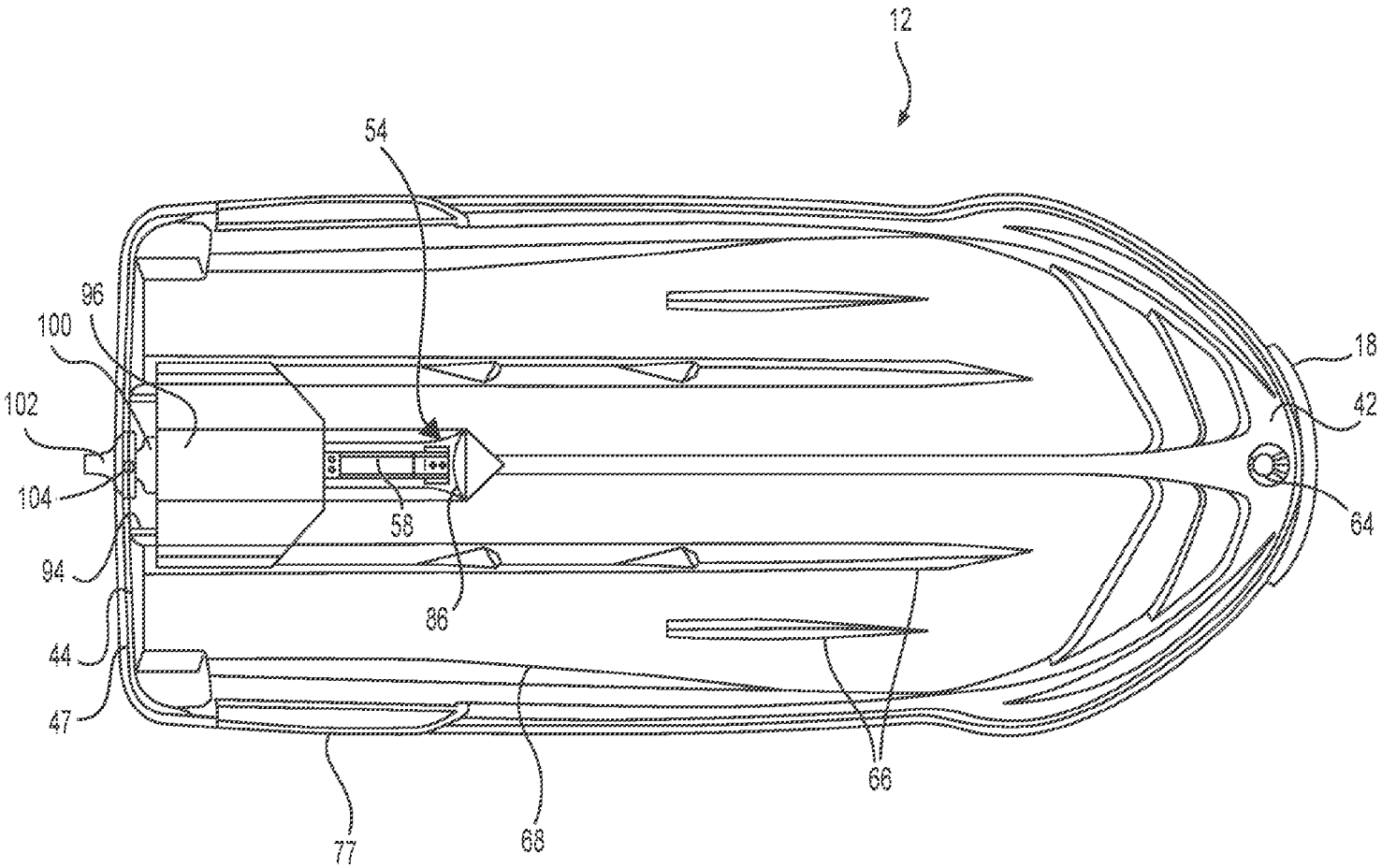
FIG. 5 is a bottom plan view of the watercraft of FIG. 1.
Figure 8:
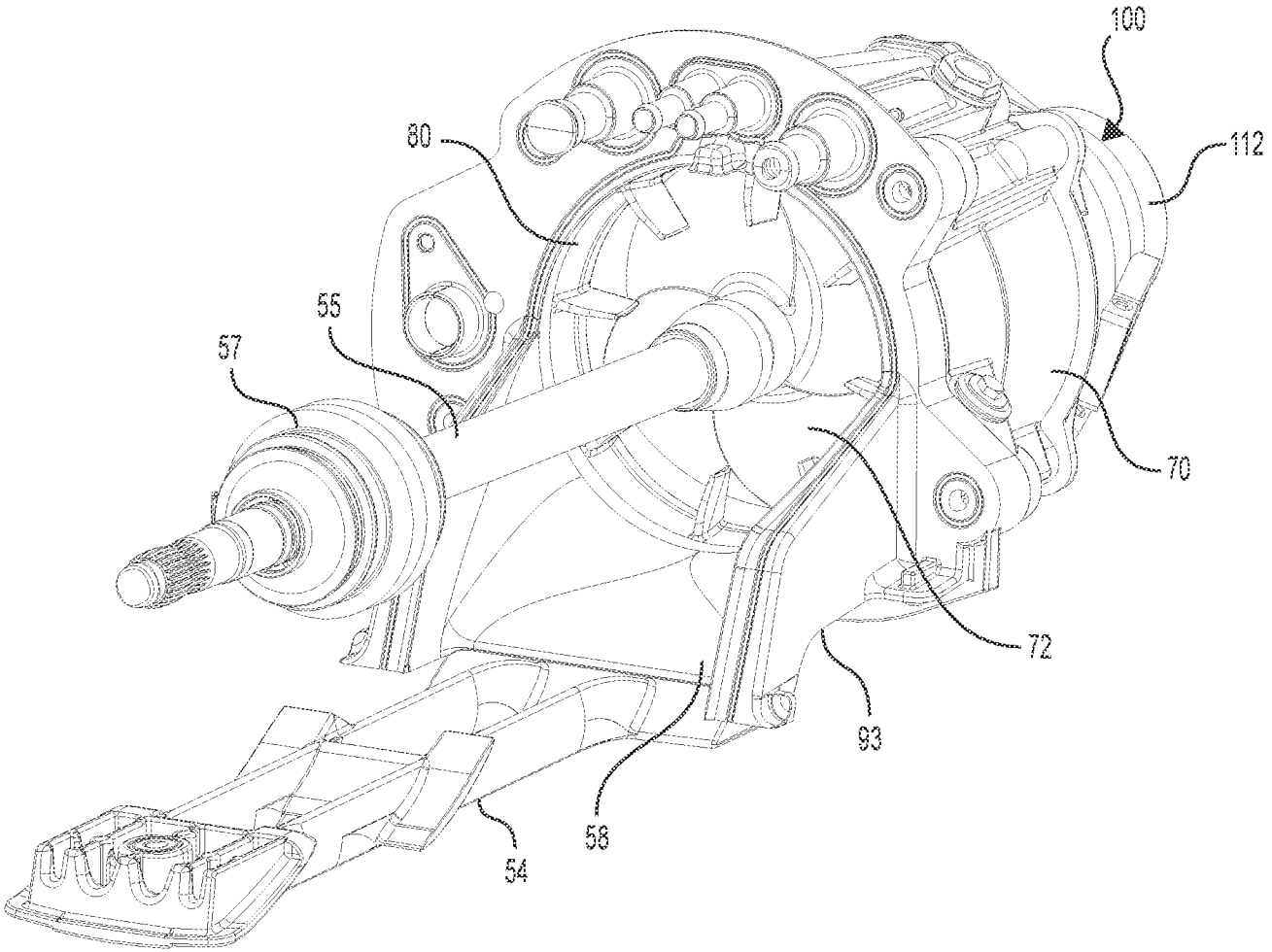
FIG. 8 is a perspective view, taken from a front, left side, of the components of the jet propulsion system of FIG. 7.
Figure 9:
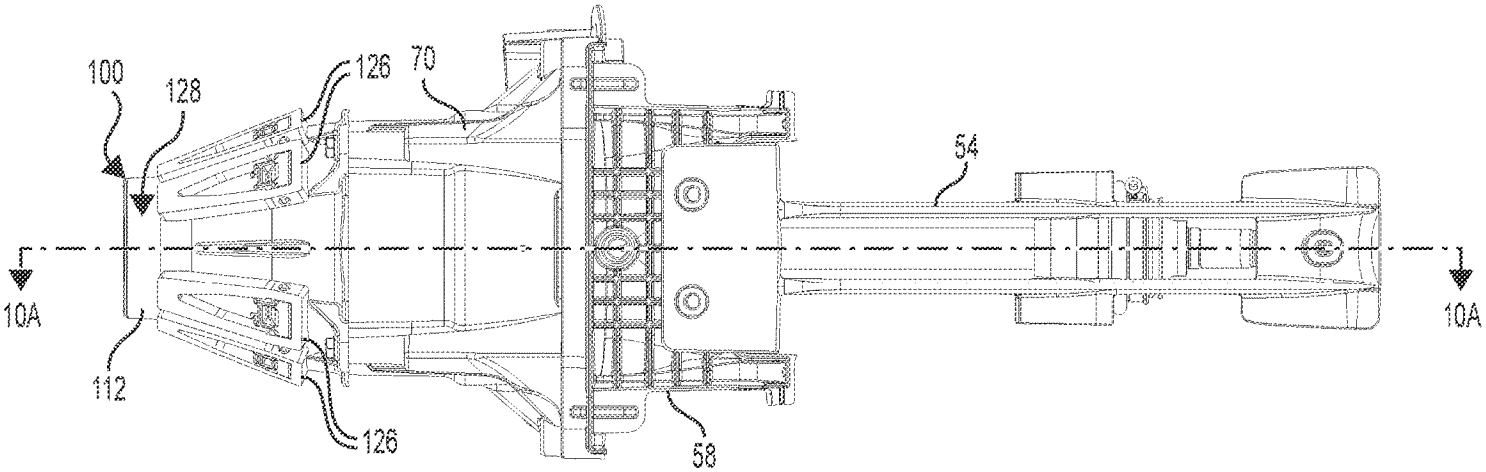
FIG. 9 is a bottom plan view of the components of the jet propulsion system of FIG. 7.

As best seen in FIG. 5, the duct 52 has an inlet 86 positioned under the hull 12. When the jet propulsion system 50 propels water rearwardly, water is first scooped into the inlet 86. An inlet grate 54 is positioned adjacent (i.e., at or near to) the inlet 86 and is configured to prevent large rocks, weeds, and other debris from entering the water jet propulsion system 50, which may damage the system or negatively affect performance. It is contemplated that the inlet grate 54 could be positioned in the inlet 86. Water flows from the inlet 86 through the water intake ramp 58. The intake ramp 58 has a top portion 90 that is formed by the hull 12 and a bottom portion 92 that is formed by a ride shoe 93 (FIG. 8).

The impeller housing 70 is positioned rearwardly of the intake ramp 58 such that, when the jet propulsion system 50 propels water rearwardly along the duct 52, water flows into the impeller housing 70 from the intake ramp 58. The impeller housing 70 is located in the tunnel 94 of the hull 12. The impeller housing 70 is fastened to the tunnel 94 of the hull 12 via bolts that engage openings 39 (FIGS. 11, 12) in the impeller housing 70 and corresponding openings in the front wall of the tunnel 94.

Figure 10A:
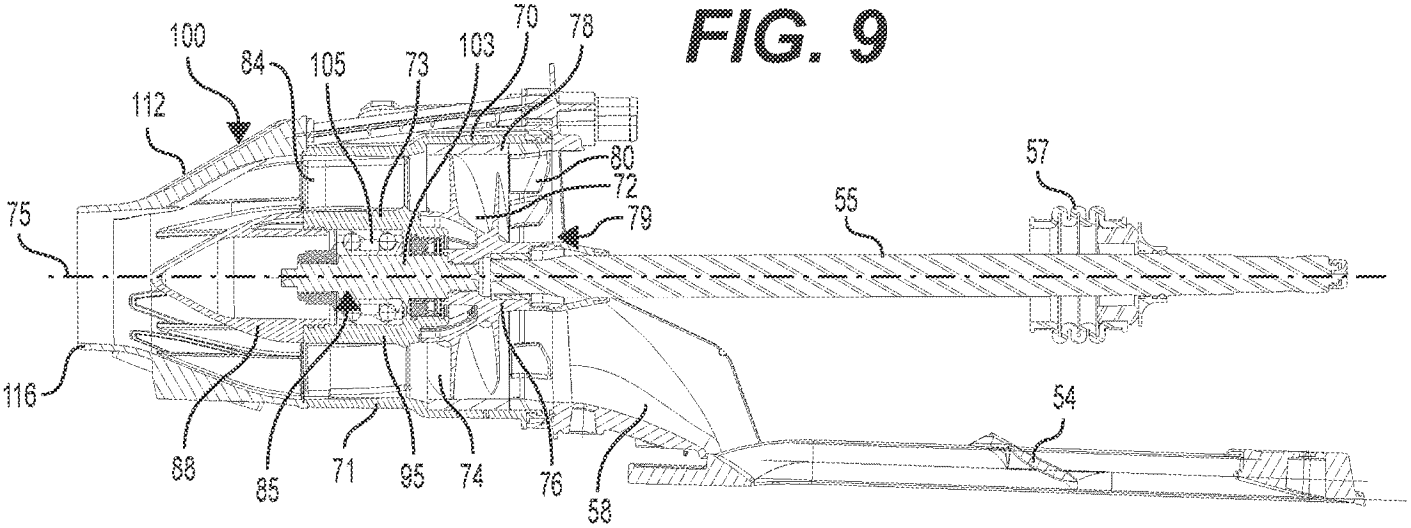
FIG. 10A is a cross-sectional view of the components of the jet propulsion system of FIG. 9 taken along line 10A-10A in FIG. 9.

As best seen in FIG. 10A, the impeller housing 70 has a generally funnel-shaped wall 71 defining a chamber 79. The impeller housing 70 also has flanges 35, at a front end of the impeller housing 70, provided with the openings 39. Two conduits 91, which extend generally parallel to one another, are formed integrally with the wall 71 and are disposed vertically above the wall 71. The conduits 91 are fluidly connected to bilge pumps (not shown) for expelling bilge water from the hull 12. The conduits 91 are connected to corresponding conduits of the venturi unit 100 as will be described in greater detail below.

An annular wear ring 78 is disposed within the chamber 79 and is fixed to the outer wall 71. The wear ring 78 is provided to absorb wear in place of the impeller housing 70.

An impeller 72 is housed within the impeller housing 70 and is configured to pressurize water pulled into the duct 52 of the jet propulsion system 50. More specifically, the impeller 72 is enclosed within the chamber 79 defined by the wall 71 of the impeller housing 70. The wear ring 78 surrounds the impeller 72 such that sand and/or other particles are thrown by the impeller 72 onto the wear ring 78 instead of the impeller housing 70.

The impeller 72 has a plurality of blades 74 arranged around a central hub 76. The central hub 76 of the impeller 72 is mounted to the driveshaft 55 via an opening provided in the central hub 76 such that the impeller 72 is rotated about an impeller rotation axis 75 (FIG. 10A) defined by the driveshaft 55. The impeller 72 is thus operatively connected to the engine 22 via the driveshaft 55 and the gearbox 25. Rotation of the impeller 72 about the impeller rotation axis 75 pulls water into the duct 52 and propels it either rearwardly or forwardly depending on the direction of rotation of the impeller 72.

A forward stator 73 is disposed within the chamber 79 rearwardly of the impeller 72. The forward stator 73 has a hub 95 and a plurality of vanes 84 extending radially outwardly from the hub 95 to the wall 71 of the impeller housing 70. The vanes 84 are spaced circumferentially from one another and extend radially within the duct 52. When the impeller 72 is operated in the forward direction, water is propelled towards the forward stator 73 such that the vanes 84 thereof decrease the rotational motion of the water so that the energy given to the water is used for thrust, as opposed to swirling the water.

Figure 10B:
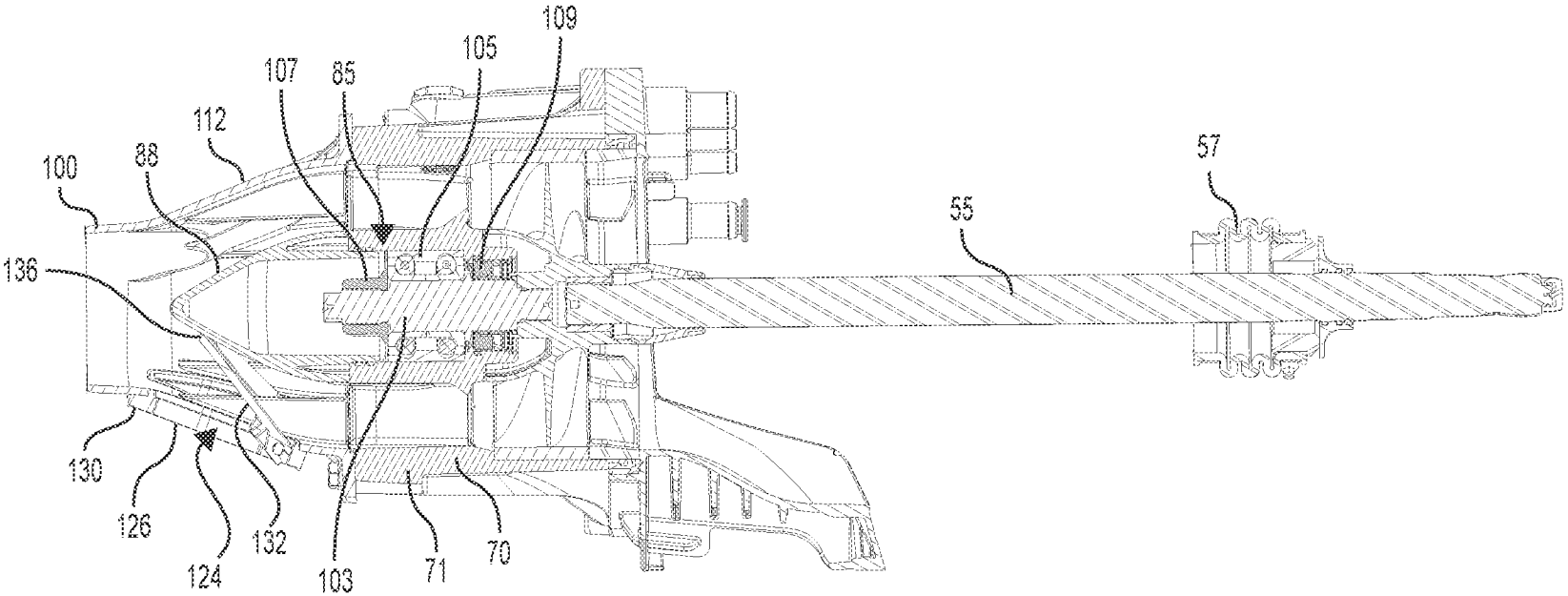
FIG. 10B is a cross-sectional view of the jet propulsion system of FIG. 9, with the steering nozzle, reverse gate, intake grate and other components removed therefrom, in which doors of a venturi unit of the jet propulsion system are in an open position.

As best seen in FIGS. 10A and 10B, a bearing assembly 85 is provided for supporting the impeller 72 and reducing noise generated by rotation of the impeller 72. The bearing assembly 85 includes a shaft 103 and a bearing 105 mounted to the shaft 103. The shaft 103 is connected to a rear end of the central hub 76 of the impeller 72 and extends rearwardly therefrom. The bearing 105 is mounted between the shaft 103 and the hub 95 of the forward stator 73. Seal members 107, 109 of the bearing assembly 85 are mounted to the shaft 103 on either side of the bearing 105 in order to seal the bearing 105.

A nose cone 88 is fastened to a rear end of the hub 95 of the forward stator 73 and improves hydrodynamic flow of water within the jet propulsion system 50. The nose cone 88 is fastened to the rear end of the hub 95 of the forward stator 73 by fasteners (e.g., bolts). It is contemplated that the nose cone 88 may be fastened to the hub 95 in any other suitable way.

Since the gearbox 25 can selectively rotate the driveshaft 55 clockwise or counterclockwise, the impeller 72 can be rotated in a "forward direction" or in a "reverse direction". When the impeller 72 rotates in the forward direction, the impeller 72 propels water rearwardly (i.e., towards an outlet of the duct 52) such that the pressurized water propels the watercraft 10 forward. Conversely, when the impeller 72 rotates in the reverse direction, the impeller 72 propels water towards the inlet 86 of the duct 52. The impeller 72 is rotated in the reverse direction to clear debris or other foreign bodies clogged at the inlet grate 54 or other parts of the jet propulsion system 50.

A reverse stator 80 is disposed within the chamber 79 and is fixed to the wall 71 of the impeller housing 70. The stator 80 is positioned forwardly of the impeller 72 such that the reverse stator 80 is positioned between the impeller 72 and the inlet 86 of the duct 52. The reverse stator 80 is generally annular and has a plurality of vanes 82 provided on an inner side of the reverse stator 80 and extending radially within the duct 52. The vanes 82 are circumferentially spaced from one another. When the impeller 72 is rotated in the reverse direction such that the impeller 72 propels water towards the reverse stator 80 and the inlet 86 of the duct 52, the vanes 82 of the reverse stator 80 decrease the rotational motion of the water so that almost all the energy given to the water is used for thrust, as opposed to swirling the water. This may therefore facilitate unclogging foreign bodies from the jet propulsion system 50. Moreover, when the impeller 72 is rotated in the forward direction such that the impeller 72 propels water rearwardly towards the outlet of the duct 52, the vanes 82 of the reverse stator 80 reduce swirling of the water upstream (i.e., frontwardly) of the impeller 72.

The impeller housing 70, the impeller 72, the forward and reverse stators 73, 80, the bearing assembly 85 and the wear ring 78 are commonly collectively referred to as a "jet pump".

The steering nozzle 102 defines an outlet of the duct 52 of the jet propulsion system 50. Notably, the steering nozzle 102 is disposed rearwardly of the venturi unit 100 such that, when the jet propulsion system 50 propels water rearwardly (i.e., when the impeller 72 rotates in the forward direction), water flows from the venturi unit 100 into the steering nozzle 102.

The steering nozzle 102 is pivotally attached to the venturi unit 100 so as to pivot about a vertical axis 104 (FIG. 4). The steering nozzle 102 could also be supported at the exit of the tunnel 94 in other ways without a direct connection to the venturi unit 100. When the jet propulsion system 50 propels water rearwardly along the duct 52, the steering nozzle 102 selectively directs the thrust generated by the jet propulsion system 50 to effect turning. The steering nozzle 102 can be replaced by a rudder or other diverting mechanism disposed at the exit of the tunnel 94 to selectively direct the thrust generated by the jet propulsion system 50.

The steering nozzle 102 is operatively connected to the helm assembly 60 preferably via a push-pull cable (not shown) such that when the helm assembly 60 is turned, the steering nozzle 102 pivots. This movement redirects the pressurized water coming from the venturi unit 100, so as to redirect the thrust and steer the watercraft 10 in the desired direction. Optionally, the steering nozzle 102 may be gimbaled to allow it to move around a second horizontal pivot axis. The up and down movement of the steering nozzle 102 provided by this additional pivot axis is known as trim and controls the pitch of the watercraft 10.

When the jet propulsion system 50 propels water forwardly along the duct 52 (i.e., when the impeller 72 rotates in the reverse direction), water gets sucked into the duct 52 via the outlet of the steering nozzle 102.

The watercraft 10 is also provided with a reverse gate 110 which is movable between a stowed position (see FIGS. 4 and 6) where it does not interfere with the jet of water being expelled rearwardly along the duct 52 by the jet propulsion system 50 and a plurality of positions where it redirects the jet of water being expelled rearwardly along the duct 52 by the jet propulsion system 50. Notably, the reverse gate 110 can be actuated into a neutral position in which the thrust generated by the jet propulsion system 50 does not have a horizontal component such that the watercraft 10 will not be accelerated or decelerated by the thrust and will stay in position if it was not moving prior to moving the reverse gate 110 in the neutral position. The reverse gate 110 can also be actuated into a reverse position as it redirects the jet of water towards the front of the watercraft 10, thus causing the watercraft 10 to move in a reverse direction.

The reverse gate 110 is pivotally connected to the ride plate 96. It is also contemplated that the reverse gate 110 could be pivotally attached to the sidewalls of the tunnel 94. Other ways of operatively mounting the reverse gate 110 to the hull 12 or jet propulsion system are also contemplated.

A reverse gate actuator 111, in the form of an electric motor, is operatively connected to the reverse gate 110 to move the reverse gate 110. The reverse gate actuator 111 could alternatively be any one of a mechanical, a hydraulic, or another type of electric actuator. One contemplated reverse gate actuator is shown and described in U.S. Pat. No. 7,841,915, issued Nov. 30, 2010, the entirety of which is incorporated herein by reference.

The venturi unit 100 is connected to the impeller housing 70 and is positioned rearwardly thereof such that the venturi unit 100 is positioned longitudinally between the impeller housing 70 and the steering nozzle 102. As such, when the impeller 72 propels water rearwardly along the duct 52, water flows from the impeller housing 70 into the venturi unit 100. The venturi unit 100 is configured to constrict water flow in order to reduce fluid pressure and increase fluid speed when the impeller 72 is driven to move the watercraft 10 forwardly.

With reference to FIGS. 13 to 17, the venturi unit 100 has a venturi conduit 112 which defines an inlet 114 and an outlet 116 opposite the inlet 114. In order to constrict water flow, the inlet 114 has a greater cross-sectional area than the outlet 116 such that the venturi conduit 112 is generally conical in shape and has a generally conical peripheral wall 118. Thus, when the impeller 72 rotates in the forward direction such that water is propelled by the impeller 72 through the inlet 114 and then out of the outlet 116 of the venturi conduit 112, the speed of the water flowing through the venturi conduit 112 increases due to the reduction in size (i.e., diameter) of the venturi conduit 112 from the inlet 114 to the outlet 116. As will be described in greater detail below, this is not the case when the impeller 72 rotates in the reverse direction (i.e., when water flows from the outlet 116 to the inlet 114 of the venturi conduit 112).

The venturi conduit 112 has mounting flanges 120 that are evenly circumferentially spaced around an end of the venturi conduit 112 that defines the inlet 114. Fasteners (e.g., bolts) are inserted into openings provided in the mounting flanges 120 and into corresponding openings in the impeller housing 70 in order to secure the venturi unit 100 to the impeller housing 70. Two conduits 97, which are outside of the venturi conduit 112, extend generally parallel to one another and are formed integrally with the venturi conduit 112. The conduits 97 are fluidly connected with the conduits 91 of the impeller housing 70. The venturi conduit 112 also has a plurality of vanes 122 for decreasing the rotational motion of water flowing within the venturi conduit 112 so that the energy given to the water by the impeller 72 is used for thrust, as opposed to swirling the water. The vanes 122 extend radially inward from the peripheral wall 118, longitudinally along an inner side of the peripheral wall 118 and are circumferentially spaced from one another.

The venturi conduit 112 defines a plurality of apertures 124 provided in the peripheral wall 118 of the venturi conduit 112. The apertures 124 are distributed along a bottom half 128 of the venturi conduit 112. That is, the apertures 124 are located below a horizontal plane containing a center axis 125 of the venturi conduit 112. Each of the apertures 124 is located between two adjacent ones of the vanes 122. As will be described below, the venturi unit 100 has a plurality of doors 126 that open and close the apertures 124 of the venturi conduit 112 to regulate water flow within the venturi conduit 112. To that end, each door 126 is connected to the venturi conduit 112 at a location of a respective one of the apertures 124.

Figure 14:
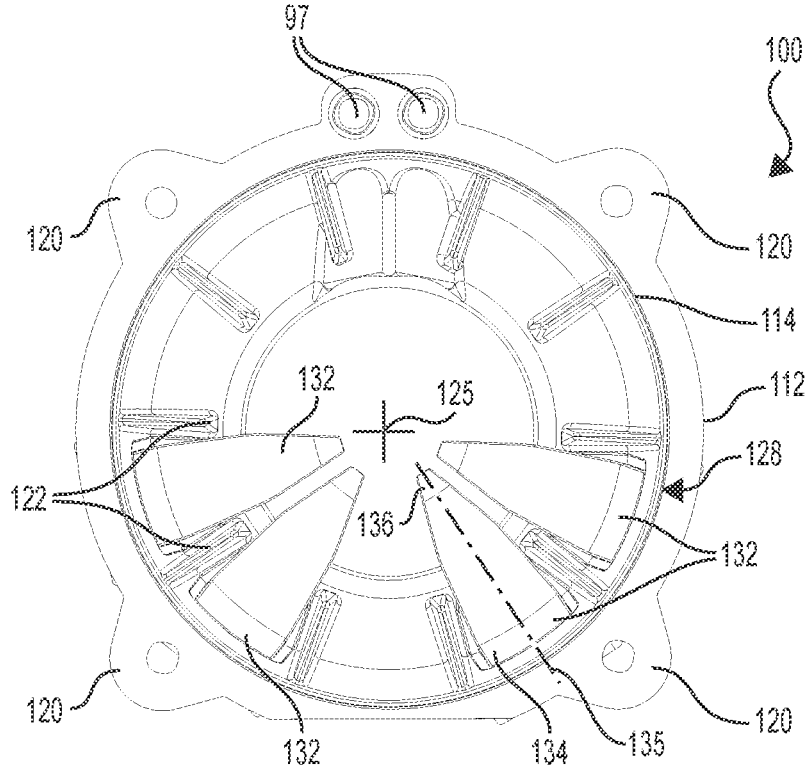
FIG. 14 is a front elevation view of the venturi unit of FIG. 13.
Figure 15:
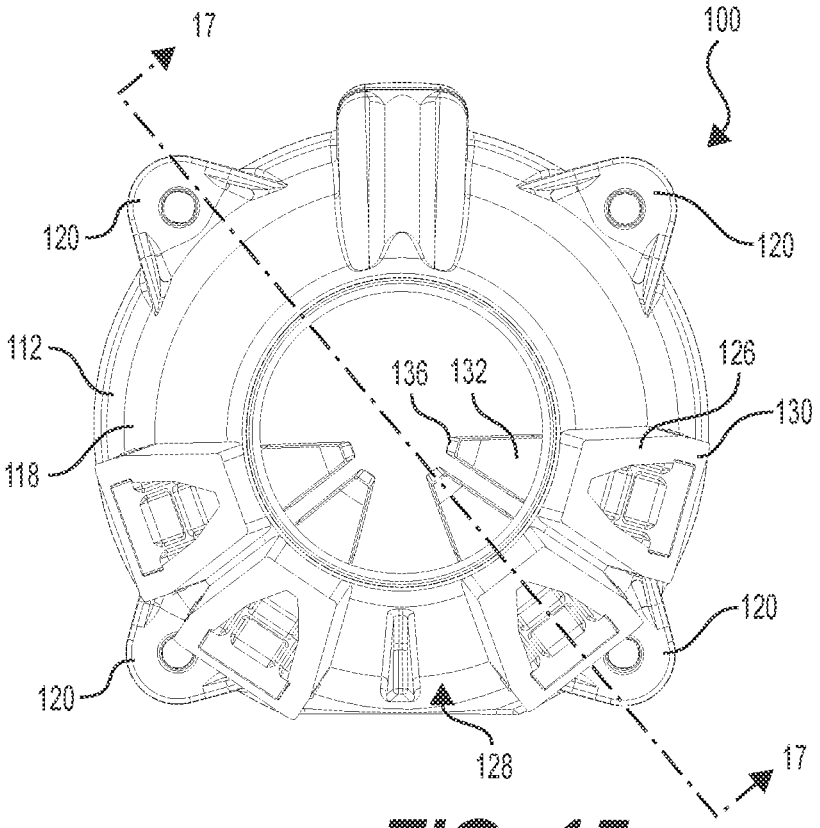
FIG. 15 is a rear elevation view of the venturi unit of FIG. 13.
Figure 16:
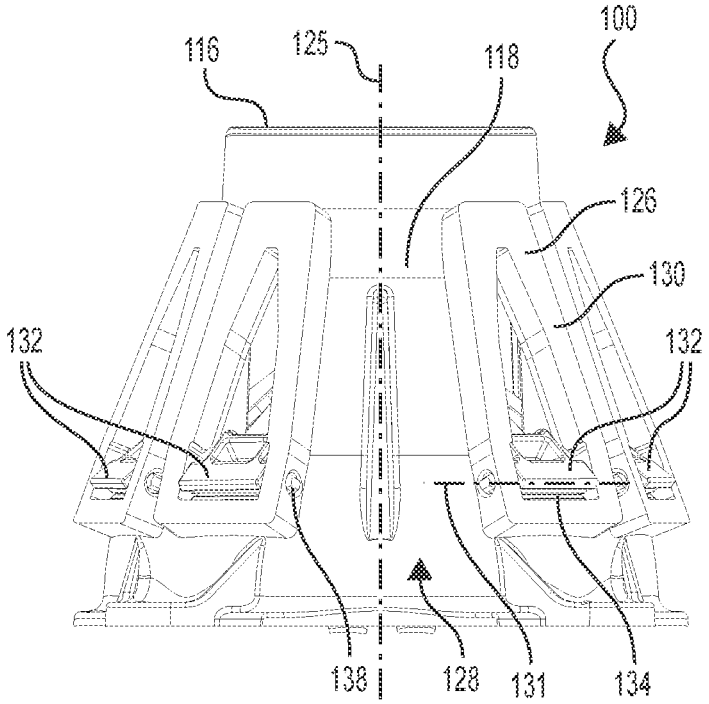
FIG. 16 is a bottom plan view of the venturi unit of FIG. 13.
Figure 17:
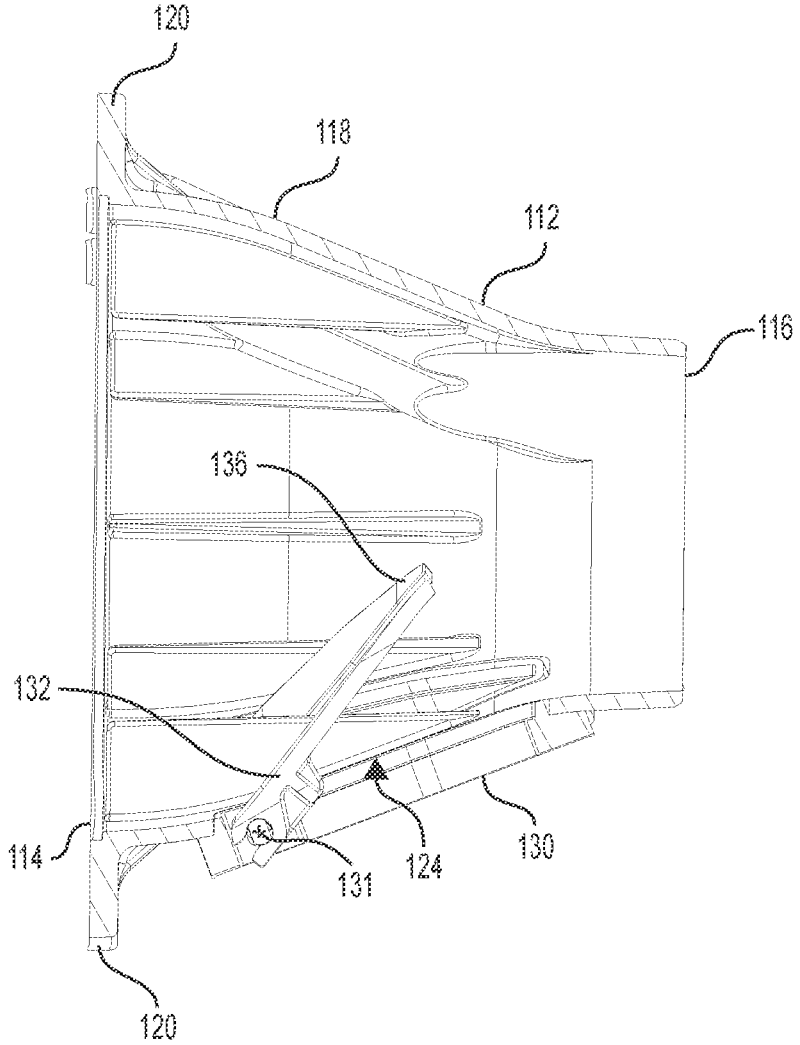
FIG. 17 is a cross-sectional view of the venturi unit of FIG. 15 taken along line 17-17 in FIG. 15.

In this embodiment, four doors 126 are provided in order to close and open the four associated apertures 124. It is contemplated that more or fewer doors may be provided (e.g., a single door 126, two doors 126, three doors 126, five doors 126, etc.) in accordance with the number of apertures 124. The doors 126 are distributed along the bottom half 128 of the venturi conduit 112. That is, as best seen in FIGS. 14 to 16, the doors 126 are located below the horizontal plane containing the center axis 125 of the venturi conduit 112. Moreover, each of the doors 126 is positioned between two adjacent ones of the vanes 122 of the venturi conduit 112.

Each door 126 has a door seat 130 and a door member 132 that is pivotably connected to the door seat 130. In this embodiment, all of the doors 126 have the same configuration and therefore only one of the doors 126 will be described in detail below. The door member 132 extends from a proximal end 134 to a distal end 136 (FIG. 14). The door member 132 is hinged to the door seat 130 about a hinge axis 131 via pins 138 (FIG. 16) protruding from the sides of the door member 132 near the proximal end 134. The pins 138 are engaged in corresponding openings of the door seat 130. In this embodiment, the door seat 130 has a generally trapezoidal shape and the door member 132 has a generally triangular shape such that the doors 126 are generally triangular having a wide end and a narrow end. It is contemplated that the doors 126 could be shaped and sized differently in other embodiments. Moreover, in this embodiment, as shown in FIG. 14, the doors 126 are oriented such that a longitudinal axis 135 of each door 126, extending from the proximal end 134 to the distal end 136 of the door member 132, extends through the center axis 125 of the venturi conduit 112 when the door member 132 is fully opened.

Figure 11:
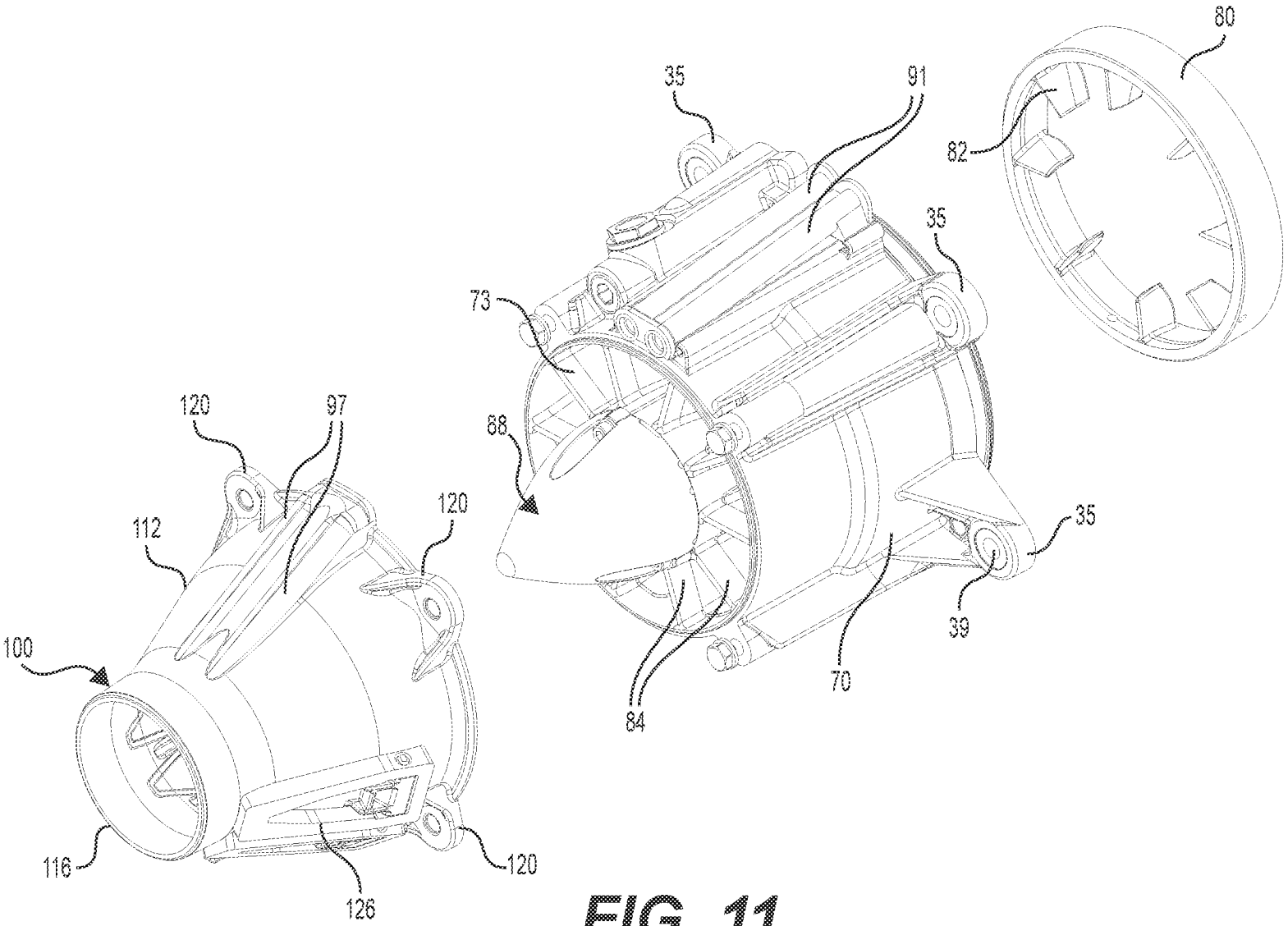
FIG. 11 is an exploded view, taken from a rear, right side, of a venturi unit, a jet pump and a reverse stator of the jet propulsion system of FIG. 6.
Figure 12:
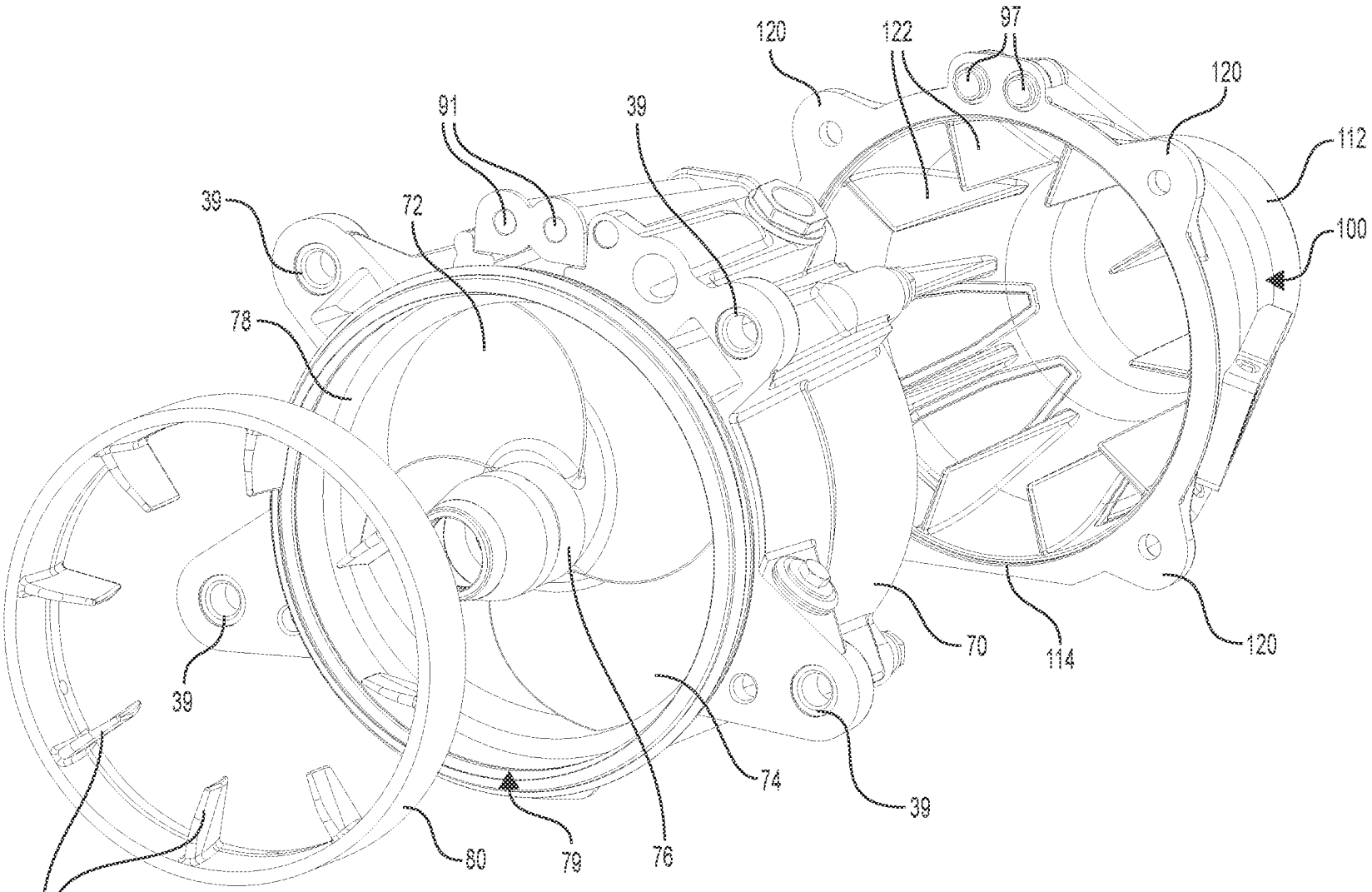
FIG. 12 is an exploded view, taken from a front, left side, of the venturi unit, the jet pump and the reverse stator of the jet propulsion system of FIG. 6.
Figure 13:
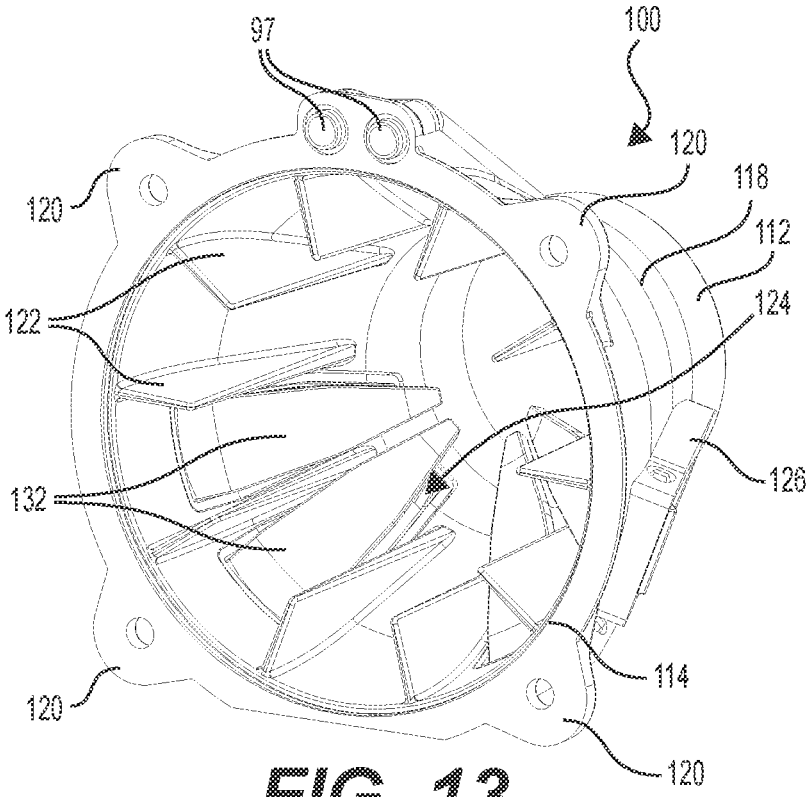
FIG. 13 is a perspective view, taken from a front, left side, of the venturi unit of the jet propulsion system of FIG. 6 in which doors of the venturi unit are in an open position.

Each of the doors 126 is movable between a closed position and an open position. In the closed position, as shown in FIGS. 11 and 12, the door 126 closes its associated aperture 124. More specifically, in the closed position, the door member 132 of the door 126 is shut against the door seat 130 such that the distal end 136 of the door member 132 is in contact with the door seat 130. Conversely, in the open position, as shown in FIGS. 13 to 17, the door 126 opens the associated aperture 124 such that water is able to flow therethrough. That is, in the open position, the door member 132 of the door 126 is pivoted relative to the door seat 130 such that the distal end 136 of the door member 132 is distanced from the door seat 130. In particular, the distal end 136 of the door member 132 is pivoted inwardly into the venturi conduit 112 such that the distal end 136 of the door member 132 is closer to the center axis 125 of the venturi conduit 112 than in the closed position of the door 126. Moreover, in this embodiment, in the open position, the distal end 136 of the door member 132 of the door 126 abuts the nose cone 88 (FIG. 10B) which extends into the venturi conduit 112 of the venturi unit 100. In other words, the open position of the door 126 is limited by the nose cone 88 abutting the door member 132. It is contemplated that the open position of the door 126 could be limited in any other suitable way. For instance, in some embodiments, a stopper or any suitable mechanism for limiting motion of the door member 132 could be implemented.

The doors 126 can be configured differently in other embodiments. For instance, with reference to FIGS. 18 and 21, in an alternative embodiment, doors 126' are provided instead of doors 126. Each of the doors 126' has the same configuration and thus only one of the doors 126' will be described here. The door 126' has an elongated trapezoid shape such that both the door seat 130' and the door member 132' are trapezoidal. The door member 132' is hinged to the door seat 130' about a hinge axis via pins 138' protruding from the sides of the door member 132' near the proximal end 134' which are engaged in corresponding recesses of the door seat 130'. A protruding lip 135' on an inner side 145' of the door seat 130' is fitted into the aperture 124 of the peripheral wall 118 of the venturi conduit 112. The door seat 130' is secured to the venturi conduit 112 via an adhesive. It is contemplated that the door seat 130' may be secured to the venturi conduit 112 in any other suitable way (e.g., via a fastener).

Figure 18:
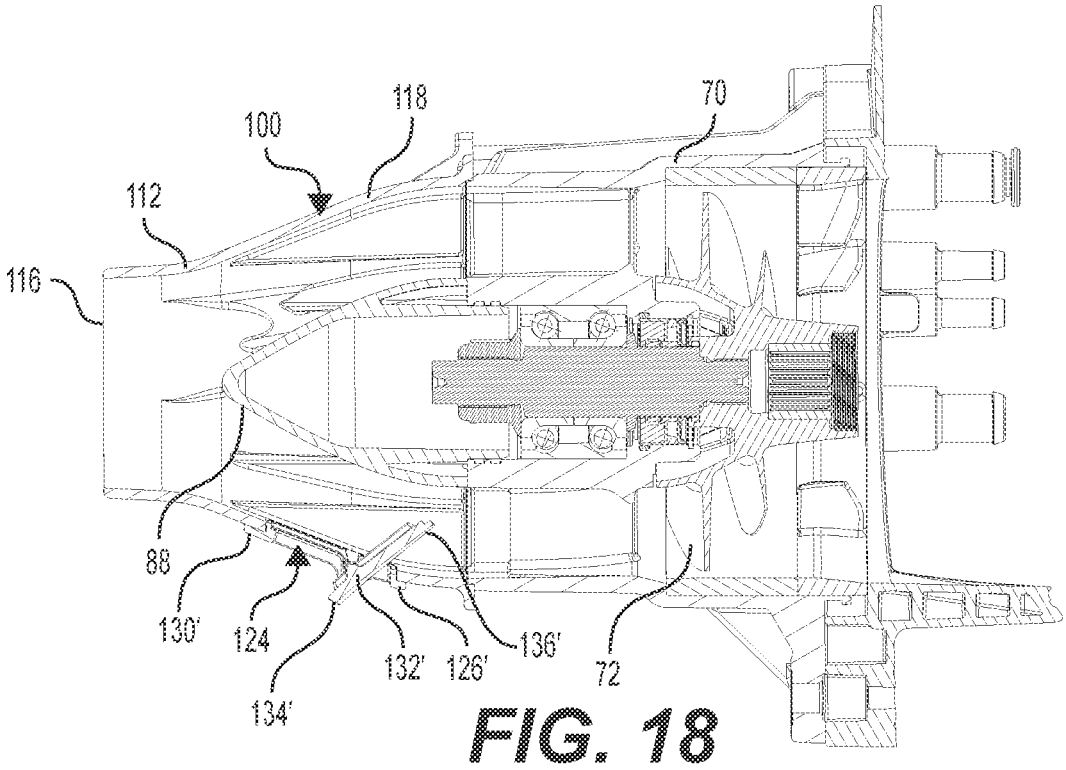
FIG. 18 is a cross-sectional view of part of the jet propulsion system including a venturi unit in accordance with an alternative embodiment of the present technology in which the doors of the venturi unit are in an open position.
Figure 19:
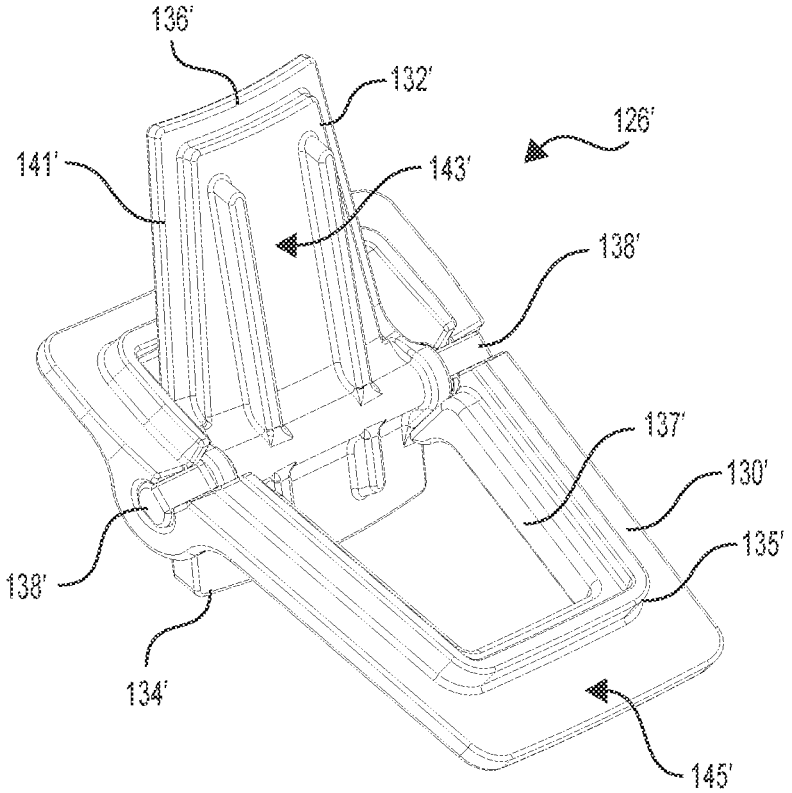
FIG. 19 is a perspective view, taken from a rear, left side, of a door of the venturi unit of FIG. 18.
Figure 20:
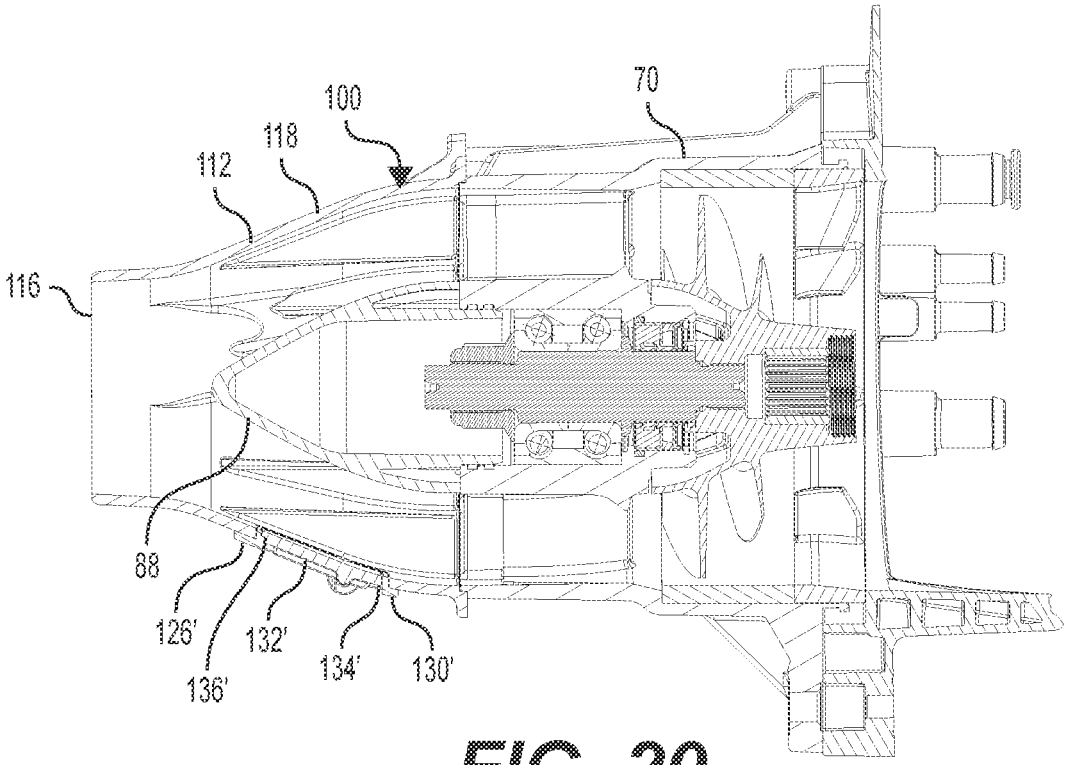
FIG. 20 is a cross-sectional view of the part of the jet propulsion system of FIG. 18, in which the doors of the venturi unit are in a closed position.
Figure 21:
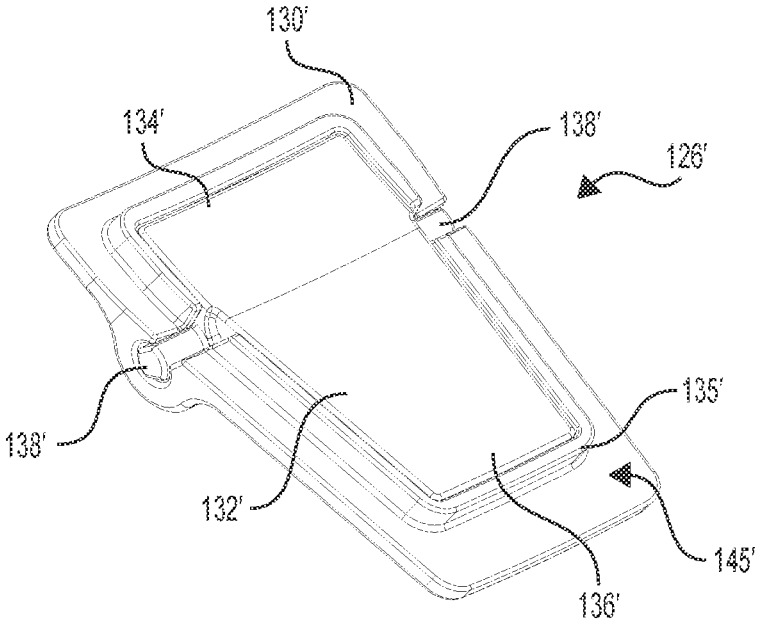
FIG. 21 is a perspective view, taken from a rear, left side, of the door of the venturi unit of FIG. 19, in which the door is in the closed position.

In the closed position of the door 126', as shown in FIGS. 20 and 21, an inner peripheral wall 137' of the door seat 130' on an inner side 145' thereof is in contact with an outer peripheral wall 141' on an outer side 143' of the door member 132'. In the open position of the doors 126', as shown in FIGS. 18 and 19, the distal end 136' of the door member 132' is pivoted inwardly into the venturi conduit 112 while the proximal end 134' is pivoted outwardly of the venturi conduit 112 (see FIG. 18). Moreover, a distance between the proximal and distal ends 134', 136' of the door member 132' is smaller than in the previously described embodiment such that, in the open position of the door 126', the door member 132' is not abutted by the nose cone 88. Rather, in the open position, the door 126' abuts the protruding lip 135' of the door seat 130'. As such, the door 126' pivots inwardly into the venturi conduit 112 more than the previously described door 126. Notably, in the open position, the distal end 136' of the door 126' is disposed frontwardly of a vertical plane containing the hinge axis of the door 126'.

The doors 126' otherwise function in a similar manner to the doors 126 described above and thus the remainder of the description will only refer to the doors 126.

The doors 126 are passively actuated between the closed and open positions. Notably, a pressure differential between the inside and outside of the venturi conduit 112 causes the doors 126 to pivot between the closed and open positions. The pressure differential between the inside and outside of the venturi conduit 112 depends on the direction of rotation of the impeller 72 (i.e., whether the impeller 72 propels water out of the venturi unit 100 or out of the inlet 86 of the duct 52). When the impeller 72 rotates in the forward direction, the pressure on an inner side of any given one of the doors 126 is greater than the pressure on an outer side of that door 126 such that a pressure differential at the inner side of the door 126 is positive. This positive pressure differential causes the doors 126 to assume the closed position such that the door members 132 are shut against the door seats 130 and thus inhibit water flow through the apertures 124. On the other hand, when the impeller 72 rotates in the reverse direction, the pressure on the inner side of any given one of the doors 126 is less than the pressure on the outer side of that door 126 such that the pressure differential at the inner side of the door 126 is negative. This negative pressure differential causes the doors 126 to assume the open position such that the distal ends 136 of the door members 132 pivot inwardly into the venturi conduit 112 and thus allow water flow through the apertures 124.

Thus, when the impeller 72 rotates in the forward direction such that the doors 126 are in the closed position, water flows into the venturi conduit 112 through the inlet 114 and out through the outlet 116 of the venturi conduit 112. Conversely, when the impeller 72 rotates in the reverse direction such that the doors 126 are in the open position, water flows into the venturi conduit 112 through the outlet 116 as well as through the apertures 124 and then out through the inlet 114 of the conduit 112. Thus, since the apertures 124 are open when the impeller 72 is rotated in the reverse direction, water flow into the venturi conduit 112 and to the impeller 72 is increased relative to a jet propulsion system and venturi unit without the doors 126 where, if the jet propulsion system were operated in reverse, water would only enter through the outlet of the venturi conduit.

The venturi unit 100 of the present technology provides greater water flow when the impeller 72 rotates in the reverse direction, therefore allowing the jet propulsion system 50 to generate greater thrust to facilitate the dislodgement of debris or other foreign bodies clogging the duct 52 (e.g., at the inlet grate 54). In addition, this allows the impeller 72 to run at higher speeds while generating a significantly small pressure differential to avoid or otherwise minimize cavitation of the impeller 72.

It is contemplated that, rather than being passively actuated by the pressure differential within the venturi conduit 112, in alternative embodiments the doors 126 could be actively actuated by an actuator that changes the position of one or more of the doors 126. For instance, in such embodiments, the actuator could be a step motor that selectively pivots the door member 132 relative to the door seat 130 in order to close and open the door 126. In yet other embodiments, the actuator could be a spring that biases the door member 132 such as to close the door 126.

Moreover, it is contemplated that the venturi unit 100 could be provided separately as an after-market accessory for replacing a conventional venturi unit. For example, the venturi unit 100 could be provided as part of a kit that also includes the gearbox 25 and, in some embodiments, the driveshaft 55 such that a conventional jet propulsion system can be retrofit with the kit. Notably, in embodiments in which the kit include the driveshaft 55, the driveshaft 44 provided with the kit is shorter than that of the original conventional jet propulsion system since the driveshaft 55 is sized to accommodate the gearbox 25 which is not provided in the conventional jet propulsion system.

Modifications and improvements to the above-described embodiments of the present technology may become apparent to those skilled in the art. The foregoing description is intended to be exemplary rather than limiting. The scope of the present technology is therefore intended to be limited solely by the scope of the appended claims.

What is claimed is:

1. A jet propulsion system for a watercraft, comprising:

a duct defining an inlet;

a venturi unit defining part of the duct and defining a venturi outlet;

an impeller housing defining part of the duct and disposed between the inlet and the venturi unit; and an impeller disposed within the impeller housing, the impeller being rotatable about an impeller rotation axis in (i) a forward direction whereby the impeller propels water out of the venturi outlet, and (ii) a reverse direction whereby the impeller propels water out of the inlet, the venturi unit comprising:

a venturi conduit having a peripheral wall defining at least one aperture, the venturi conduit defining a venturi inlet and the venturi outlet, the venturi inlet having a greater cross-sectional area than the venturi outlet, wherein:

when the impeller rotates in the forward direction, water flows from the venturi inlet to the venturi outlet, and when the impeller rotates in the reverse direction, water flows from the venturi outlet to the venturi inlet;

and at least one door connected to the venturi conduit, the at least one door being movable between a closed position when the impeller rotates in the forward direction, and an open position when the impeller rotates in the reverse direction, in the closed position, the at least one door closing the at least one aperture, and in the open position, the at least one door opening the at least one aperture such that water flows into the venturi conduit via the at least one aperture.

2. The jet propulsion system of claim 1, wherein, in the open position, the at least one door opens the at least one aperture such that water flows into the venturi conduit via the at least one aperture and the venturi outlet.

3. The jet propulsion system of claim 1, wherein the at least one door includes a plurality of doors.

4. The jet propulsion system of claim 1, wherein:

each of the at least one door comprises:

a door seat; and a door member pivotably connected to the door seat;

in the closed position of the at least one door, the door member being shut against the door seat; and in the open position of the at least one door, the door member being pivoted inwardly such that at least part of the door member is pivoted into the venturi conduit.

5. The jet propulsion system of claim 3, wherein the plurality of doors comprises no more than four doors.

6. The jet propulsion system of claim 3, wherein the doors of the plurality of doors are distributed along a bottom half of the venturi conduit.

7. The jet propulsion system of claim 3, wherein:

the venturi conduit comprises a plurality of vanes extending longitudinally along an inner side of the peripheral wall, the vanes being circumferentially spaced from one another;

each of the doors of the plurality of doors being positioned between two of the vanes.

8. The jet propulsion system of claim 1, wherein the at least one door is generally triangular.

9. The jet propulsion system of claim 1, wherein the at least one door is passively actuated between the closed and open positions such that:

when a pressure inside the venturi conduit is less than a pressure outside the venturi conduit, the at least one door assumes the open position; and when the pressure inside the venturi conduit is greater than the pressure outside the venturi conduit, the at least one door assumes the closed position.

10. The jet propulsion system of claim 1, further comprising:

a reverse stator disposed between the impeller and the inlet of the duct, the reverse stator being generally annular and comprising a plurality of vanes extending radially within the duct.

11. The jet propulsion system of claim 1, further comprising:

an intake ramp defining part of the duct and extending from the inlet of the duct to the impeller housing.

12. The jet propulsion system of claim 1, further comprising:

a drive shaft operatively connected to the impeller to cause rotation of the impeller about the impeller rotation axis, the driveshaft being adapted for connection to a gearbox.

13. The jet propulsion system of claim 1, further comprising:

a forward stator disposed between the impeller and the venturi unit, the forward stator comprising a plurality of vanes extending radially within the duct.

14. The jet propulsion system of claim 13, further comprising:

a nose cone mounted to the forward stator and extending into the venturi unit, the at least one door abutting the nose cone in the open position.

15. The jet propulsion system of claim 1, further comprising a grate adjacent to or in the inlet of the duct.

16. A watercraft, comprising:

a hull having a bow and a stern opposite the bow;

a motor supported by the hull; and a jet propulsion system, comprising:

a duct defining an inlet in a bottom of the hull;

a venturi unit defining part of the duct and defining a venturi outlet;

an impeller housing defining part of the duct and disposed between the inlet and the venturi unit; and an impeller disposed within the impeller housing, the impeller being operatively connected to the motor, the impeller being rotatable about an impeller rotation axis in (i) a forward direction whereby the impeller propels water rearwardly, and (ii) a reverse direction whereby the impeller propels water forwardly, the venturi unit comprising:

a venturi conduit having a peripheral wall defining at least one aperture, the venturi conduit defining a venturi inlet and the venturi outlet, the venturi inlet having a greater cross-sectional area than the venturi outlet, wherein:

when the impeller rotates in the forward direction, water flows from the venturi inlet to the venturi outlet, and when the impeller rotates in the reverse direction, water flows from the venturi outlet to the venturi inlet;

and at least one door connected to the venturi conduit, the at least one door being movable between a closed position when the impeller rotates in the forward direction, and an open position when the impeller rotates in the reverse direction, in the closed position, the at least one door closing the at least one aperture, and in the open position, the at least one door opening the at least one aperture such that water flows into the venturi conduit via the at least one aperture.

* * * * *